United States Patent [19]

Johnson et al.

[11] Patent Number: 4,813,316

[45] Date of Patent: Mar. 21, 1989

[54] CONTROL SYSTEM AND METHOD FOR A FOOD PRODUCT SLICER

[75] Inventors: Kevin K. Johnson, Trotwood; Gerald M. Bruckner, Englewood; Brian E. Bader, Springfield, all of Ohio

[73] Assignee: Hobart Corporation, Troy, Ohio

[21] Appl. No.: 131,499

[22] Filed: Dec. 10, 1987

[51] Int. Cl.[4] ..... B26D 7/06

[52] U.S. Cl. ..... 83/42; 83/71; 83/73; 83/365; 83/435.1; 83/717; 83/730; 83/731

[58] Field of Search ..... 83/42, 707, 340, 435.1, 83/703, 71, 72, 74, 435.2, 717, 731, 730, 368, 365, 39

[56] References Cited

U.S. PATENT DOCUMENTS

| | | | |
|---|---|---|---|
| 3,051,207 | 8/1962 | Hartley . | |
| 3,319,681 | 5/1967 | Anecki | 83/435.1 |
| 3,452,833 | 7/1969 | Wolters | 83/77 |
| 3,938,602 | 2/1976 | Sly et al. | 83/707 |
| 4,266,456 | 5/1981 | Oostvogels | 83/435.1 |

*Primary Examiner*—Donald R. Schran
*Assistant Examiner*—Rinaldi Rada
*Attorney, Agent, or Firm*—Biebel, French & Nauman

[57] ABSTRACT

A food product slicer includes a rotating blade and a carriage for supporting the food product. The carriage is mounted for lateral motion along a linear path to bring the food product into contact with the blade. A drive motor is selectively connected to the carriage for movement of the carriage along the path. In accordance with a method of automatically operating the slicer, the carriage is moved along the path by the motor to a predefined reference position nearest the operator. A motor position count is initialized, and during all motor energization, a count is generated corresponding to incremental movement of the carriage along its path. The motor is energized for a count to move the carraige to a position corresponding to a start of a slicing stroke. The motor is then energized for a count sufficient to move the carriage to a second position corresponding to a completion end of the slicing stroke.

41 Claims, 23 Drawing Sheets

| | | | |
|---|---|---|---|
| FIG. 9A | FIG. 9B | FIG. 9C | FIG. 9D |
| FIG. 9E | FIG. 9F | FIG. 9G | FIG. 9H |
| FIG. 9I | FIG. 9J | FIG. 9K | |

204
CARRIAGE LENGTH CHANGE REQUEST ?
YES
206
CHANGE CARRIAGE TRAVEL LENGTH
NO
216
MANUAL MODE REQUEST ?
YES
220
ENTER MANUAL MODE; RELEASE CARRIAGE FOR MANUAL OPERATION
NO
228
AUTO MODE REQUEST ?
YES
238
ENTER AUTO MODE; OPERATE CARRIAGE MOTOR
NO
249
STROKE LENGTH CHANGE REQUEST ?
YES
251
CHANGE STROKE LENGTH
NO

CONTROL SYSTEM AND METHOD FOR A FOOD PRODUCT SLICER

BACKGROUND OF THE INVENTION

The present invention relates generally to apparatus for forming a plurality of slices of food products such as meat, cheese and the like. More particularly, the invention relates to a control system by which the slicer may be controlled for manual operation or for operation in an automated fashion.

Slicing machines have been commercially available for many years, with a typical example shown in U.S. Pat. No. 3,051,207. In the machine shown therein, and as is typical with slicing machines, a gravity feed of the food product material to the slicing blade is used. In such an arrrangement, the rotating slicing blade is supported in a plane extending at an angle to vertical, usually an angle of about 45°. A carriage for supporting the food product may be in the form of a V in cross section, with the side walls thereof intersecting at the bottom of the carriage and extending generally at right angles with respect to the slicing plane. Thus, the angle at which the material rests within the carriage is sufficient to cause the material to slide downwardly toward the slicing plane.

The carriage may be moved reciprocally in the direction of the plane of the blade. A gauge plate or wall is generally provided ahead of the knife, so that as the carriage is withdrawn on its return stroke from the blade, the material will slide into contact with the gauge plate. As the carriage is moved on its forward or slicing stroke, the end of the material will engage the knife and a slice will be removed, with the thickness of the slice being determined by the setting of the gauge plate with respect to the slicing plane.

It is desirable to provide such a slicer which can be automatically controlled. In this way, specific numbers of slices may be produced, thereby adding convenience for the operator and minimizing food product wastage. To enhance productivity, it is also desirable to be able to control the stroke length for the carriage as well as carriage speed, in accordance with parameters which are dependent upon the nature and size of the particular food product to be sliced, to simulate normal manual operation.

It should also be possible to operate the slicer manually, since circumstances will exist where the quantity of slices is unknown ahead of time. However, such capability for manual operation should not be detrimental to the automatic operation of the slicer.

What is needed, therefore, is a control system for a food product slicer that enables automatic operation in a manner such as is described above. Such a control system should allow the number of slices, stroke length and stroke speed to be controlled. At the same time, the control system should permit manual operation without adversely affecting later automatic operation of the slicer.

SUMMARY OF THE INVENTION

In meeting this need, the present invention provides a control system for a food product slicer and a method of automatically controlling the slicer. The slicer includes a rotating blade and a carriage for supporting the food product. The carriage is mounted for lateral reciprocating motion along a linear path with respect to the blade to bring the food product into and out of contact with the cutting periphery of the blade. The slicer further includes a motor drivingly connected to the carriage for movement of the carriage along the linear path.

The control method, in accordance with the present invention, includes moving the carriage along the path by energizing the motor to a predefined reference position, in the event the carriage was left in other than the reference position when last used manually. A motor position count is initialized. During all subsequent energization of the motor, a count is generated wherein each increment of the count corresponds to an incremental distance of movement of the carriage along said path. The motor is energized for a first number of counts sufficient to move the carriage to a first position along the path corresponding to a starting end of a slicing stroke. The motor is then energized for a second number of counts sufficient to move the carriage from the first position to a second position along the path corresponding to a completion end of the slicing stroke.

The method may include the further step of, prior to movement of the carriage to the reference position, selecting one of a predetermined number of stroke lengths for the slicer. Each such stroke length corresponds to a predetermined distance along the linear path. In such a case, the second position is fixed at a position along the linear path farthest from the reference position, and selection of the stroke length determines the location of the first position along the linear path.

The reference position is defined as the carriage position nearest the operator, ready to move toward the cutting periphery of the blade. Initial movement of the carriage to the reference position is made by moving the carriage toward the operator in a first direction. Subsequent movement of the carriage to the first position is made by moving the carriage in a second, opposite direction. Movement of the carriage from the first position to the second position is made by continuing to move the carriage in the second direction.

In the event the longest available stroke length is selected, the stroke will begin at the position nearest the operator. In this case, the reference and first positions will coincide. The first number of counts for motor energization will be zero.

The method may also include the further step of energizing the motor for a third number of counts sufficient to move the carriage from the second position back to the first position along the path. Movement between the first and second positions is then repeated to produce a desired stroke length to most efficiently cut a product of a given cross-sectional dimension.

The method may then also include the step of selecting the desired number of food product slices. Such selection may be made prior to movement of the carriage to the reference position.

Alternatively, the method may include repeated movement of the carriage between the first and second positions until it is desired to terminate slicer operation. Then, after the carriage is last moved to the second position, the motor is energized for a fourth number of counts sufficient to move the carriage along the path to the reference position.

Besides the method, the present invention also includes the food product slicer, which slicer includes a frame, a circular blade mounted for rotation to the frame, and means for rotationally driving the blade. A carriage is provided for supporting a food product, the carriage being connected to the frame for lateral reciprocating motion along a linear path parallel with respect to the plane of the blade to bring the food product into and out of contact with the blade. A motor is drivingly connected to the carriage for selective energization to produce movement of the carriage along the path.

A count means generates a count signal during energization of the motor, wherein each increment of the count corresponds to an incremental distance of movement of the carriage along the path. Sensor means mounted to the frame and the carriage produces a reference signal upon positioning of the carriage along the path in a reference position. A first operator-actuated switch means produces an initiation signal upon actuation of the switch means.

A control means receives the initiation signal, the reference signal and the count signal. The control means also selectively causes the motor to be energized. The control means operates, upon receiving the initiation signal, to sequentially:

a. energize the motor to move the carriage along the path until the reference signal is received;
b. deenergize the motor and initialize a cumulative count;
c. energize the motor to move the carriage along the path and simultaneously receive the count signal and update the cumulative count therewith until the cumulative count equals a first value corresponding to a first position along the path corresponding to a first end of a slicing stroke; and
d. energize the motor to move the carriage along the path and simultaneously receive the count signal and update the cumulative count therewith until the cumulative count equals a second value corresponding to a second position along the path corresponding to a second, opposite end of the slicing stroke.

The motor may be drivingly connected to the carriage by means including a pair of pulleys, one of the pulleys connected for rotation by the motor, an endless belt extending around the pulleys for driving by rotation of the pulleys, and means for engaging the carriage with the belt. The means for engaging the carriage with the belt includes a series of teeth defined on one surface of the belt, and gripping means formed by a toothed clutch carried by the carriage for engaging the belt teeth. The gripping means may in turn include an arm connected to the carriage for gripping the belt between the arm and the carriage, and may further include means for moving the arm with respect to the carriage for selectively releasing the belt.

The means for moving the arm may include an electrically-actuated solenoid. The control means is further constructed for, upon receiving the initiation signal, actuating the solenoid to cause the carriage to engage the belt.

The motor may be provided with an incremental shaft encoder mounted thereon, the count signal being generated in response to energization of the motor by the incremental shaft encoder.

The sensor means may include means for producing a beam of radiation mounted to the frame, means for detecting the presence of the beam mounted to the frame to receive the beam, and blocking means connected to the carriage for blocking the beam from the means for detecting, the means for producing, the means for detecting and the blocking means all being positioned so that the blocking means only blocks the beam when the carriage is in the reference position.

The means for producing the beam may be an LED and the means for detecting the beam may be a phototransistor. The LED and the phototransistor are mounted to the frame adjacent the reference position, and the blocking means includes a rod connected to the carriage for blocking the beam.

The reference position is preferably defined as a position along the path farthest from the cutting periphery of the blade. The control means is then operative to cause the motor to be energized in either first or second opposite directions, and movement of the carriage to the reference position is made by moving the carriage in the first direction. Movement of the carriage to a first position is then made by moving the carriage in the second direction. Movement of the carriage from the first position to the second position is made by continuing to move the carriage in the second direction.

The slicer may include second operator-actuated switch means for producing a stroke length signal. The control means is then further operative to, prior to movement of the carriage to the reference position, receive the stroke length signal and in response thereto, select one of a predetermined number of stroke lengths for the slicer, each such stroke length corresponding to a predetermined distance along the linear path. The second position may be fixed at a position along the linear path farthest from the reference position, and the control means is further operative to select the stroke length by determining the location of the first position along the linear path.

The slicer control means may be further operative, following the movement of the carriage from the first to the second position, to energize the motor for a third number of counts sufficient to move the carriage from the second position back to the first position along the path. Movement of the carriage between the first and second positions is repeated to produce a plurality of food product slices, then the carriage is moved to its reference position.

The slicer may further include third operator-actuated switch means for producing a slice count signal upon actuation. The control means is then operative to receive the slice count signal and to select the desired number of food product slices. Following production of the desired number of slices, the control means energizes the motor for a fourth number of counts sufficient to move the carriage to the reference position.

The slicer may also further include fourth operator-actuated switch means for producing a termination signal in response to actuation thereof. The control means is then further operative, upon receiving the termination signal during operation of the slicer, and after the carriage is next moved to the second position, to energize the motor for a fourth number of counts sufficient to move the carriage along the path to the reference position.

According to another aspect of the present invention, the invention provides a method of automatically controlling a food product slicer having a rotating blade and a carriage for supporting the food product. The carriage is mounted for lateral reciprocating motion along a linear path with respect to the blade to bring the food product into and out of contact with the cutting periphery of the blade by motion in, respectively, second and first directions. The slicer further includes a motor and clutch means for drivingly connecting the motor to the carriage for movement of the carriage along the path, The method includes the steps of:

a. causing the clutch means to drivingly engage the motor and the carriage;
b. energizing the motor to move the carriage in the first direction toward the operator along the path to a reference position defined along the path by maximum movement in the first direction, nearest an operator of the slicer; and
c. energizing the motor to move the carriage reciprocatingly along the path.

The motor may be energized to move the carriage to the reference position at a first speed, and energized to subsequently reciprocatingly move the carriage at a second, faster speed.

A food product slicer according to this aspect of the invention, and particularly adapted for both manual and automatic operation, includes a frame, a circular blade mounted for rotation to the frame and having a peripheral cutting edge, and means for rotationally driving the blade. A carriage supports a food product, and means is provided, connected to the frame, for mounting the carriage for lateral reciprocating motion along a linear path parallel with respect to the plane of the blade to bring the food product into and out of contact with the cutting edge of the blade by motion in, respectively, second and first directions. A carriage motor is included, and clutch means selectively engages the carriage motor to the carriage for driving movement of the carriage by the motor along the path. Sensor means is mounted to the frame and the carriage for producing a reference signal upon positioning of the carriage along the path in a reference position, the reference position being defined along the path by maximum movement in the first direction, nearest an operator of the slicer.

The slicer further includes first operator-actuated switch means for producing an initiation signal upon actuation of the switch means. A control means receives the initiation signal and the reference signal. The control means also selectively causes the clutch means to engage the motor and the carriage and causes the motor to be energized.

Upon receiving the initiation signal, the control means operates to sequentially:

a. cause the clutch means to drivingly engage the motor and the carriage;
b. energize the motor to move the carriage in a first direction toward the operator along the path until the reference signal is received; and
c. in response to receipt of the reference signal, energize the motor to move the carriage reciprocatingly along the path.

Accordingly, it is an object of the present invention to provide a method of operating a food product slicer, and a food product slicer incorporating a control system, that enables automatic operation of the slicer for producing slices of a food product; to provide such a method and apparatus that enables the operator to select, for automatic production, a predetermined number of slices; to provide such a method and apparatus that enables the operator to select a proper stroke length in accordance with the food product being sliced; to provide such a method and apparatus that produces complete, full slices even at the beginning and end of slicer operations; and to provide such a method and apparatus that permits normal manual operation of the slicer without adversely affecting later automatic operation of the slicer.

Other objects and advantages of the invention will be apparent from the following description, the accompanying drawings and the appended claims.

DETAILED DESCRIPTION OF THE PREFERRED EMBODIMENT

Figure 1:
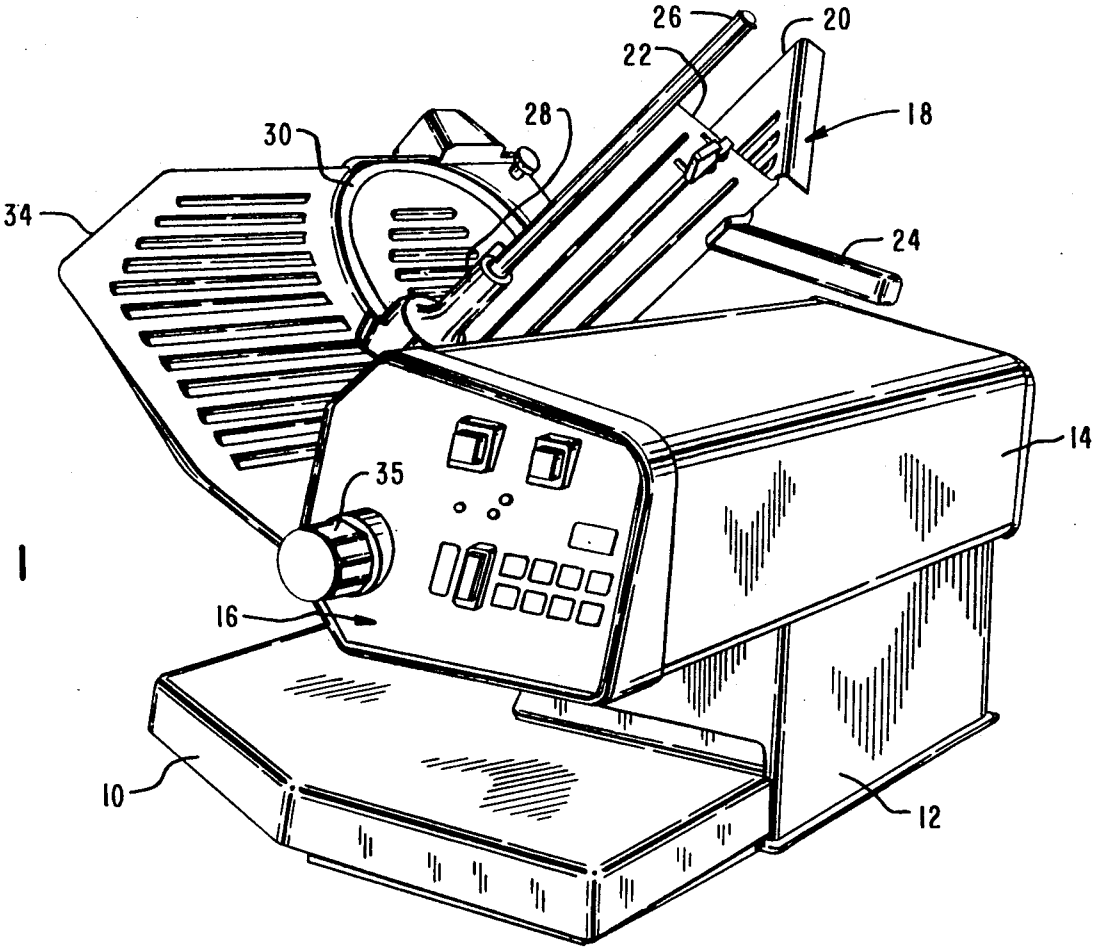
FIG. 1 is a three-quarter view of a slicer in accordance with the present invention, showing the operator actuated controls.

Referring now to the drawings, and particularly to FIG. 1, a food product slicer in accordance with the present invention is shown. The slicer includes a base plate 10 to which is connected an upright motor housing 12. Connected to the upper end of motor housing 12 is an elongated primary housing 14 having operator controls located at one end thereof as indicated generally at 16.

A food product supporting carriage 18 is mounted to the slicer by means contained within housing 14, as will be described in detail below. Carriage 18 includes planar support plates 20 and 22 which are connected to define a generally V-shaped cross section, forming the support means for the food product to be sliced. As will be described, the carriage 18 is linearly movable for carrying out the slicing operation, such movement being performed automatically or manually by the machine operator. In the latter case, a handle 24 is provided for gripping by the operator to produce linear movement. An elongated shaft 26 extends generally near an upper edge of plate 22, and is connected to the carriage for movement therewith. In a known manner, a holder 28 is provided for sliding movement along shaft 26, the holder 28 being placed aginst the food product once the product has been positioned within the carriage 18. Holder 28 aids in preenting movement of the food product during the slicing operation.

Figure 2:
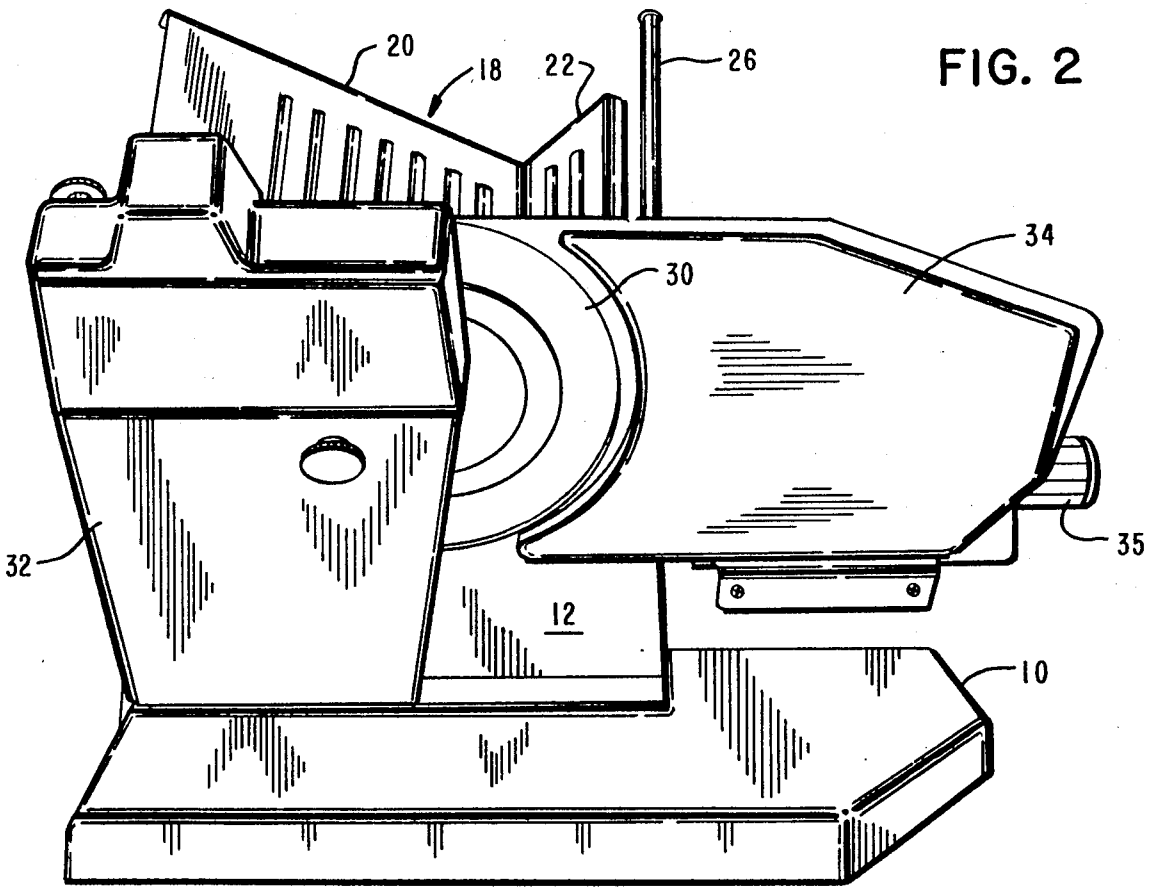
FIG. 2 is a left side view of the slicer shown in FIG. 1.

Referring now to FIG. 2, which shows the slicer in a side view, a circular cutting blade or knife 30 is mounted to a support frame 32 such that blade 30 is disposed in a plane perpendicular to that of plates 20 and 22. Referring also to FIG. 1, a gauge plate 34 is connected to housing 14 in a known manner so as to lie within a plane parallel to that of blade 30. Gauge plate 34 is adjustable such that the spacing in a normal direction between gauge plate 34 and blade 30 can be varied by rotation of a control knob 35. As a result, this provides control over the thickness of slices to be produced by the slicer.

In operation, a product to be sliced is placed within the recess defined by plates 20 and 22. Blade 30 is rotated by its drive motor, and gauge plate 34 is set at an appropriate spacing to produce the slice of desired thickness. Carriage 18 is withdrawn away from blade 30, thereby causing the food product to move by gravity into contact with gauge plate 34. Carriage 18 is then moved in an opposite direction, whereupon the food product is brought into contact with blade 30, causing a slice to be produced. Reciprocal motion of carriage 18 causes a plurality of slices to be formed.

Figures 3, 4:
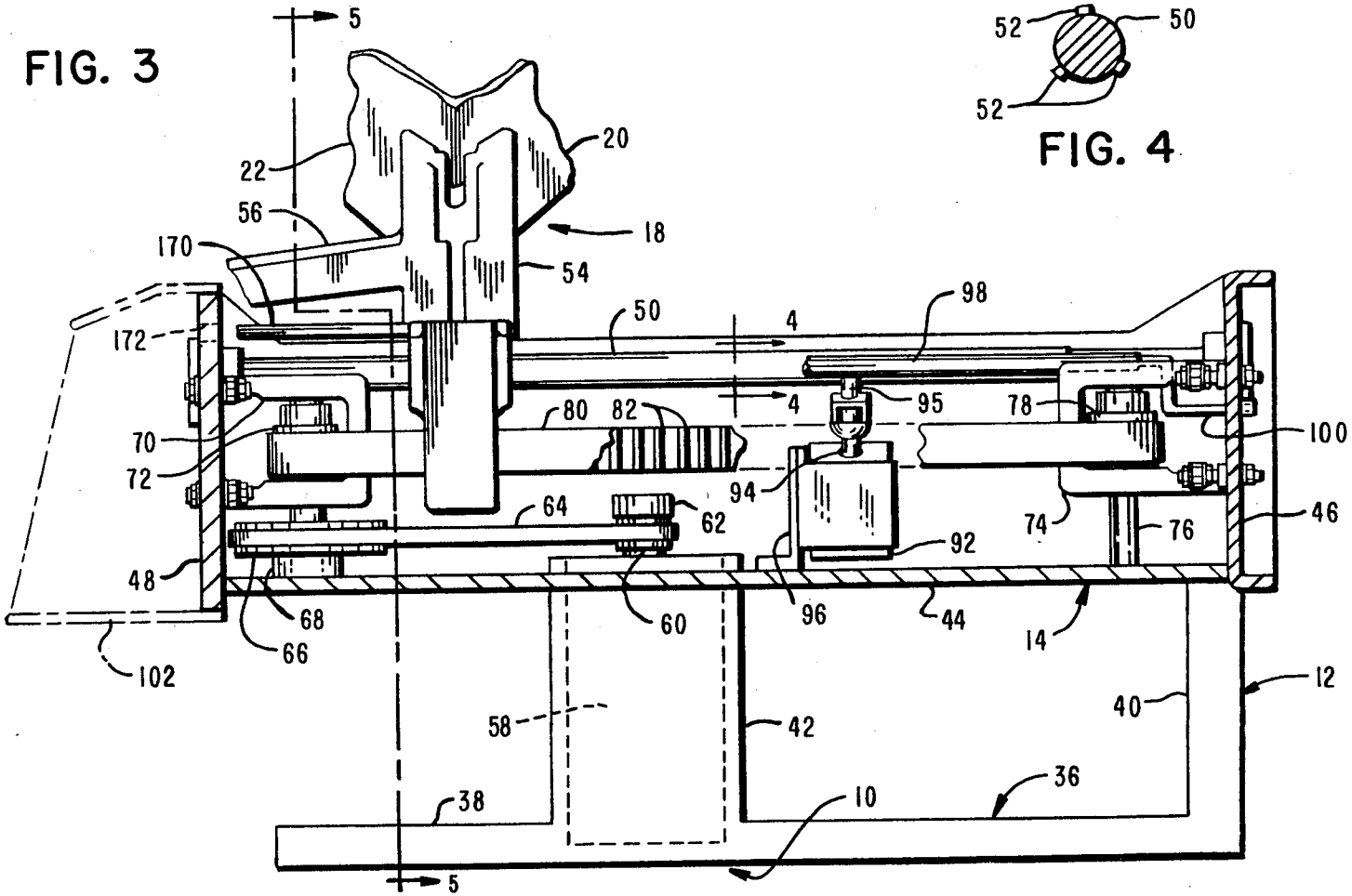
FIG. 3 is a right side view of a portion of the slicer, with the housing removed to show internal parts.
FIG. 4 is a sectional view of the carriage support shaft, taken along line 4—4 of FIG. 3.

The means by which carriage 18 is supported for reciprocal linear motion can be seen by reference to FIG. 3. A housing frame 36 includes a portion 38 defining slicer base 10, portions 40 and 42 defining motor housing 12, and a portion 44 defining primary housing 14. Frame portion 44 includes end walls 46 and 48 connected thereto. Secured between walls 46 and 48 is a carriage shaft 50, which can be seen in cross section in FIG. 4. Shaft 50 includes a plurality of splines 52, which extend along substantially the full length of carriage shaft 50.

Carriage 18 includes plates 20 and 22, along with a carriage support member 54. Extending from one side of support member 54 is support arm 56 to which is connected the carriage handle 24 (not shown in FIG. 3). As can be best seen by reference to FIG. 5, carriage support member 54 includes a sleeve 55 which is fitted onto carriage shaft 50, with an appropriate linear bearing (not shown) included to insure free linear movement of carriage support member 54 along carriage shaft 50.

For manual movement of the food product carriage, mounting of support member 54 to shaft 50 is sufficient to support the carriage and provide for its movement. However, for automatic operation, a drive motor 58 is mounted within lower housing portion 12 and includes a drive shaft 60 extending upwardly into primary housing 14. A pulley 62 is connected to the upper end of shaft 60.

A drive belt 64 extends around pulley 62 and a pulley 66 mounted to a shaft 68 secured for rotation at one end of housing 14. Shaft 68 is further supported for rotation within a yoke 70, within which a toothed pulley 72 is connected to shaft 68. A second yoke 74 is secured at an opposite end of housing 14, and rotatably supports a shaft 76 to which is attached a toothed pulley 78 identical to pulley 72.

A belt 80 extends around pulleys 72 and 78, and has a plurality of teeth 82 which cooperate with the teeth formed on pulleys 72 and 78. Thus, actuation of motor 58 drives pulley 62 and, through belt 64, drives pulley 66. This in turn rotates pulley 72 which drives belt 80.

Movement of belt 80 supplies a driving force to carriage 18 for automatic operation. The means by which such driving force is applied to the carriage can be seen by reference generally to FIG. 5. Carriage support arm 54 includes at its forwardmost end (furthest right in FIG. 5) an inwardly extending foot 84. A pair of slide pins 86 (only one shown) extends upwardly but inclinedly from foot 84. A belt grip arm 88 is positioned on slide pins 86 for sliding movement along pins 86. A gripping face 90 is defined at the lower end of arm 88, and face 90 includes a plurality of teeth (not shown) which cooperate with the teeth formed on the inner surface of belt 80. Thus, when arm 88 is in its normal position at rest on foot 84, the teeth formed on face 90 will be engaged with belt 80, gripping the belts between face 90 and the corresponding portion of carriage support member 54. By such gripping action, linear movement of belt 80 will thus result in linear movement of carriage support member 54, with member 54 sliding along carriage shaft 50.

For manual reciprocal operation of carriage 18, it is necessary to disengage carriage support member 54 from toothed belt 80. The means by which this is accomplished can be seen generally by reference to FIG. 5. A solenoid 92 includes an extendable plunger 94, solenoid 92 being secured by a bracket 96 to the interior of housing 14. The upper end of plunger 94 of solenoid 92 is pivotally connected to a short rod 95, which is in turn attached to an actuation rod 98, best seen by reference to FIG. 3. Rod 98 includes crank ends 100 (only one shown), which are pivotally mounted into end walls 46 and 48. While it will be recognized that only one crank end 100 and a portion of rod 98 is shown in FIG. 3, rod 98 extends integrally between end walls 46 and 48.

Returning to FIG. 5, it can be further seen that an upper portion of belt grip arm 88 rests on the upper side of rod 98, and slides therealong as carriage 18 is moved along support shaft 50. Thus, rod 98 may be preferably covered by a silicone sheeve, or coated with some other appropriate material, to reduce friction during movement of carriage 18.

Figure 5:
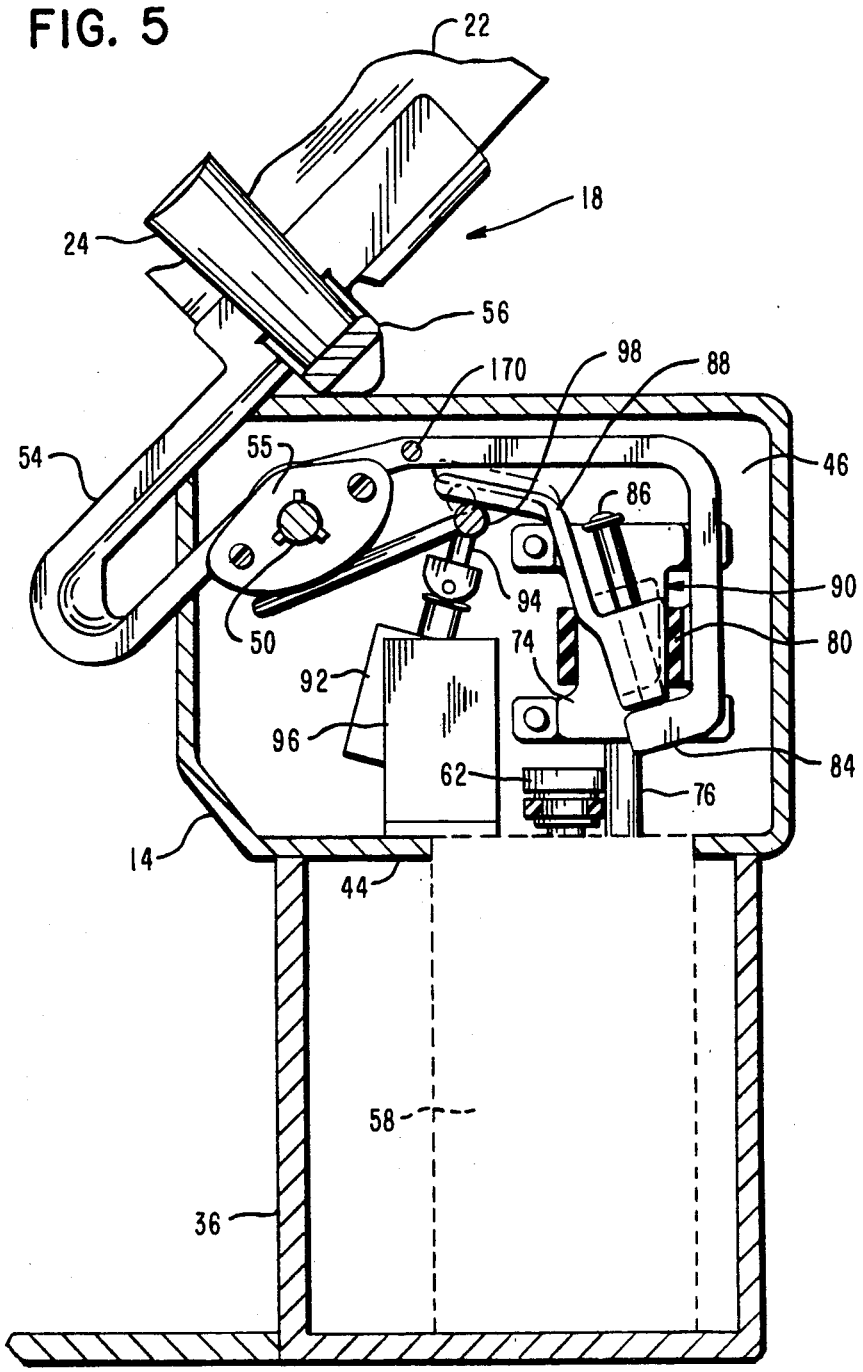
FIG. 5 is a sectional view of the portion of the slicer shown in FIG. 3, taken along line 5—5 of FIG. 3.

In the normal deenergized state for solenoid 92, plunger 94 will be extended, thereby raising rod 98 to the position shown in broken lines in FIG. 5. This in turn lifts the upper portion of arm 88, also shown in broken lines. Arm 88 is moved upwardly along slide pins 86, thereby disengaging the teeth carried on face 90 from the teeth of belt 80. Thus, the carriage 18 is totally disengaged from belt 80, and may be freely moved manually by the slicer operator. Upon energization of solenoid 92, plunger 94 will retract, rod 98 will return to its lowered position, and arm 88 will move downwardly to engage belt 80.

The control means by which slicer is controlled for either automatic or manual operation is housed within an end cap indicated generally at 102 in FIG. 3 and secured to end wall 48. End cap 102 can be seen in greater detail in FIG. 6, and includes a control panel 104 secured to the face of cap 102. Located on control panel 104 are "off" and "on" push button switches 106 and 108 respectively. Various keypad controls 110 are formed on a membrane keypad secured immediately behind control panel 104. As will be explained in further detail, keypad 110 includes among other controls, means for selecting a predetermined number of slices to be produced by the slicer. A numeric display 112 is provided on control panel 104 for indicating to the operator the number of slices selected prior to slicer operation, as well as the number of slices yet to be produced as the slicer operates.

An LED indicator 114 is included for signifying that the slicer is in a powered up state. Other LED indicators 116 and 118 are provided to indicate that the slicer is currently in an automatic or manual operational mode, respectively. Finally, control knob 35 is included for mechanically adjusting the separation between the gauge plate and slicer blade, thereby controlling slicer thickness.

Figure 7:
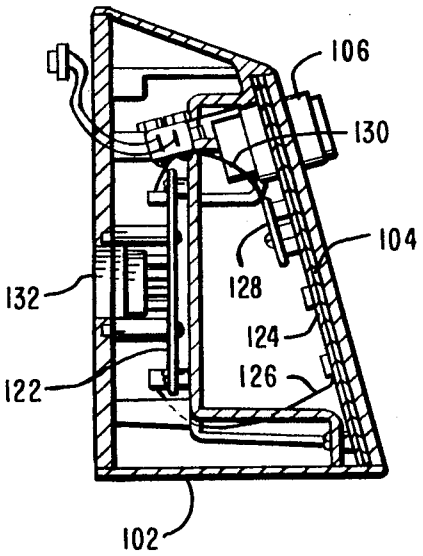
FIG. 7 is a sectional view taken generally along line 7—7 of FIG. 6.

As shown in FIG. 7, secured within end cap 102 is a primary PC board 122 having located thereon a substantial portion of the control circuitry for controlling slicer operation. A membrane keypad 124 is secured to the rear side of control panel 104, and includes the various keys for defining operator actuated controls 110 (see FIG. 6). A wiring harness 126 connects membrane keypad 124 and PC board 122. A display PC board 128 is secured behind control panel 104, and has mounted thereon the various LED indicator lamps 114, 116 and 118, along with the numeric display 112. A wiring harness 130 connects PC board 122 and 128. In addition, a wiring harness connector 132 is mounted behind PC board 122 and is electrically connected to the PC board 122. A wiring harness (not shown) is coupled to connector 132, and extends to the general power supply and carriage and blade motors as will be described below.

Figure 8:
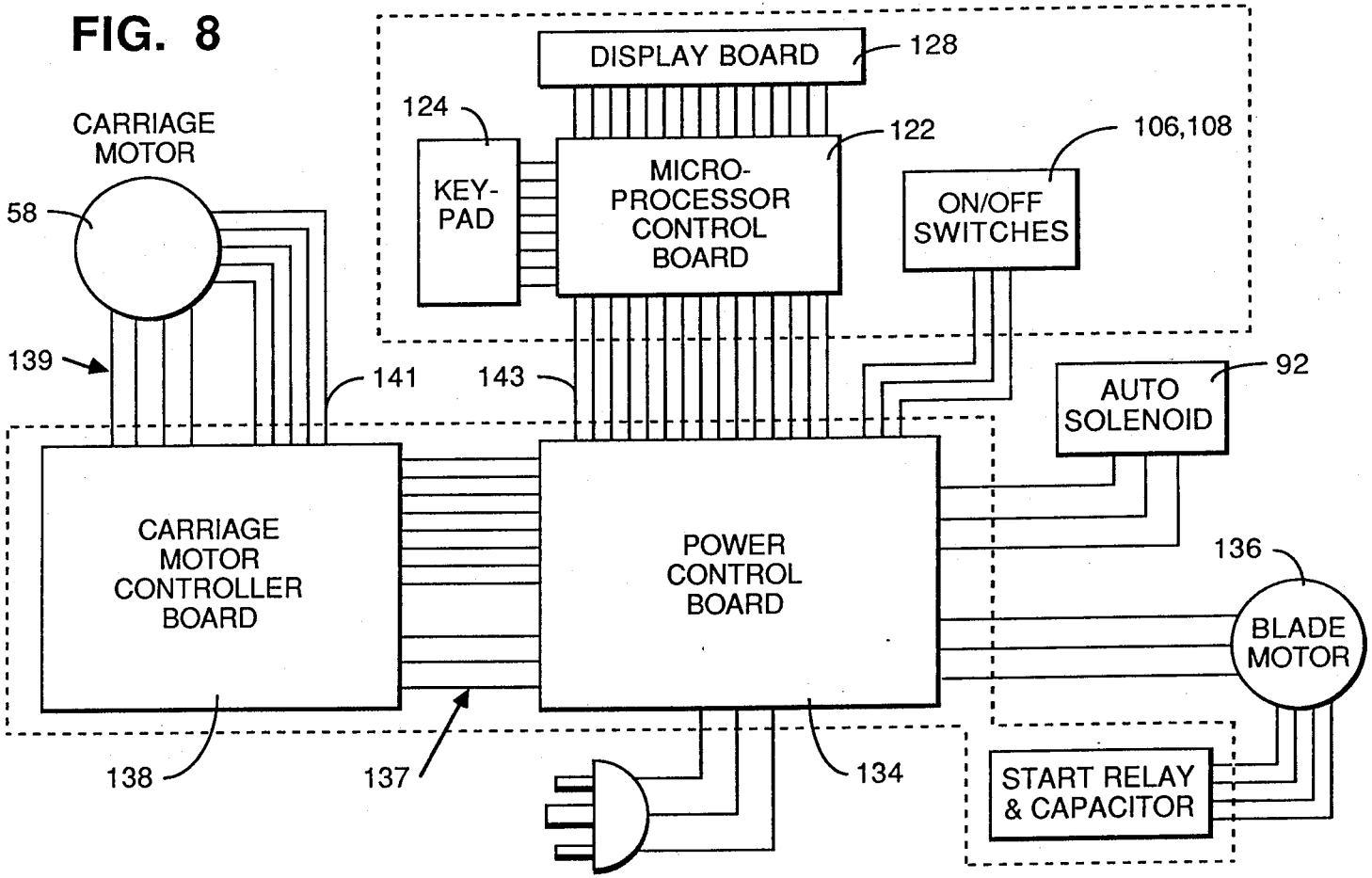
FIG. 8 is a schematic diagram of the overall electrical control system for the slicer.

The overall control system for the slicer can be seen generally by reference to the diagram of FIG. 8. 120 volt AC input power is supplied to power control board 134. Power control board 134 includes a transformer and conventional rectifiers to supply power output of 8 volts DC. From power control board 134, the 120 volt AC power is supplied to blade motor 136, which may preferably be a ⅓ horsepower, capacitor-start motor for driving the slicer blade 30 (FIGS. 1 and 2). In addition, power is supplied through harness 137 to motor controller circuit board for carriage motor 58, which is an electronically commutated motor. In the preferred embodiment, motor 58 is a brushless DC motor. The electronically commutated motor is controlled and supplied power for energization through harness 139 by motor controller circuit board 138, which is commrecially available and conventional for use with motors of the electronically commutated type. In the preferred embodiment, controller board 138 is available from Automotion, Inc. of Ann Arbor, Mich. Such a controller supplies the motor 58 with the necessary energization pulses which result in motor operation. In addition, as is known, an incremental shaft encoder is mounted on the motor, the count signal being generated in response to energization of the motor by the incremental shaft encoder. The count signal then is comprised of train of electrical pulses corresponding to motor energization. This signal is received by motor controller 138 through harness 141. It will be recognized that each pulse in the received train corresponds to one increment of movement of motor 58, and hence of the slicer carriage.

Power control board 134 additionally provides actuation energy for solenoid 92 used to cause engagement of the food product carriage with the drive belt for automtic operation, as has been described.

Additionally, power control board 134 supplies an 8 volt DC power input signal through harness 143 to processor board 122. Board 122 is also connected via control lines within harness 143 to power control board 134 for control of power to solenoid 92 and motor controller 138. Board 122 also receives the train of pulses from carriage motor 58, which train is passed through power control board 134. Further, processor control board 122 is connected to keypad 124 and display board 128.

Finally, power control switchs 106 and 108, physically located on the control panel, are connected to the power supply 134 to cause the slicer to be placed in a power up or power down condition, in a known manner.

Figures 9, 9K:
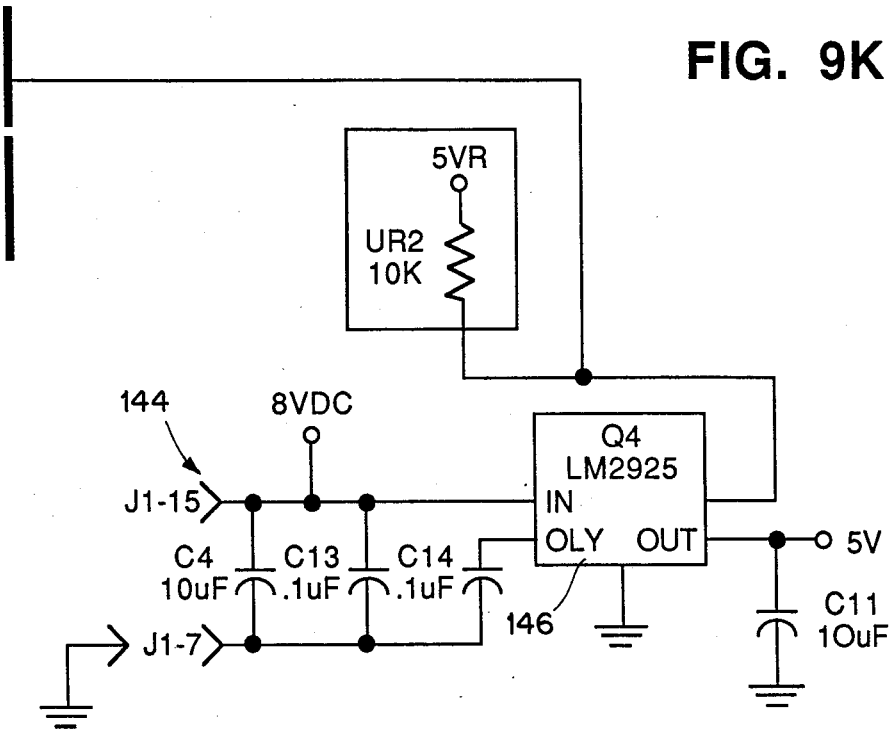
FIGS. 9A–9K together comprise FIG. 9, which is a detailed schematic of the microprocessor control board of the electrical control system.
Figure 9A:
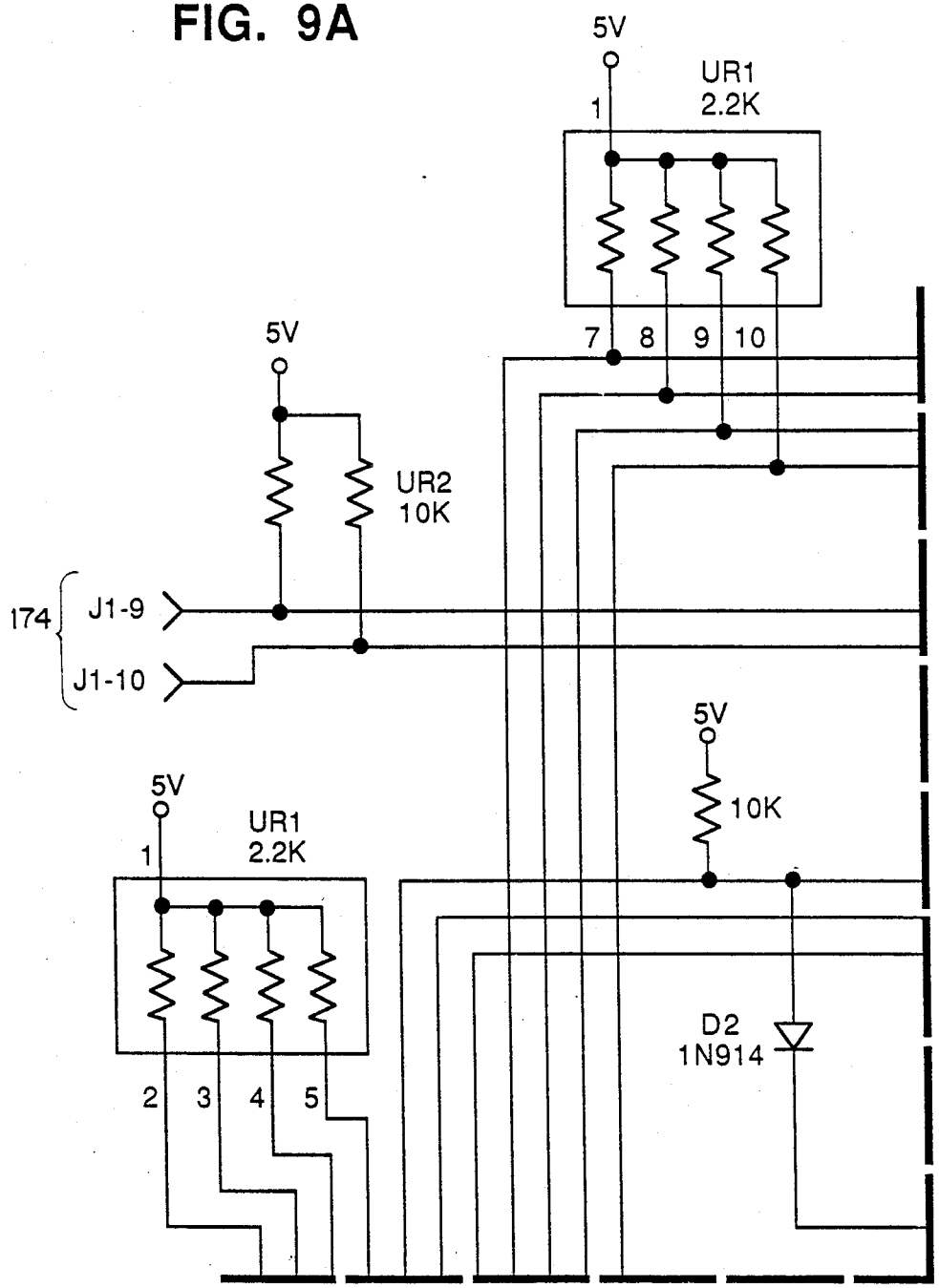

The control circuitry contained on processor board 122 can be seen in detail by reference to FIG. 9. Control of the slicer is generally by microprocessor 142, which is preferably a 6803 processor commercially available from Motorola. Power is supplied to microprocessor 142 and the remainder of processor board 122 by a power input shown at 144. A voltage regulator 146 is included, to provide a regulated 5 volt DC input for powering the various devices located on board 122.

Microprocessor 142 communicates with a memory chip 148, preferably an EPROM, and more preferably a 2764 chip available from several commercial sources. Memory 148 is coupled to microprocessor 142 through latch 150, which is preferably an LS373 chip available from Motorola.

A data input supplied from memory 148 and a clock input supplied from microprocessor 142 are directed to a serial-to-parallel shift register 152, which may preferably be an MM5450 chip available from National Semiconductor. Serial-to-parallel shift register 152 supplies the control output for the various components of the slicer.

Figure 10:
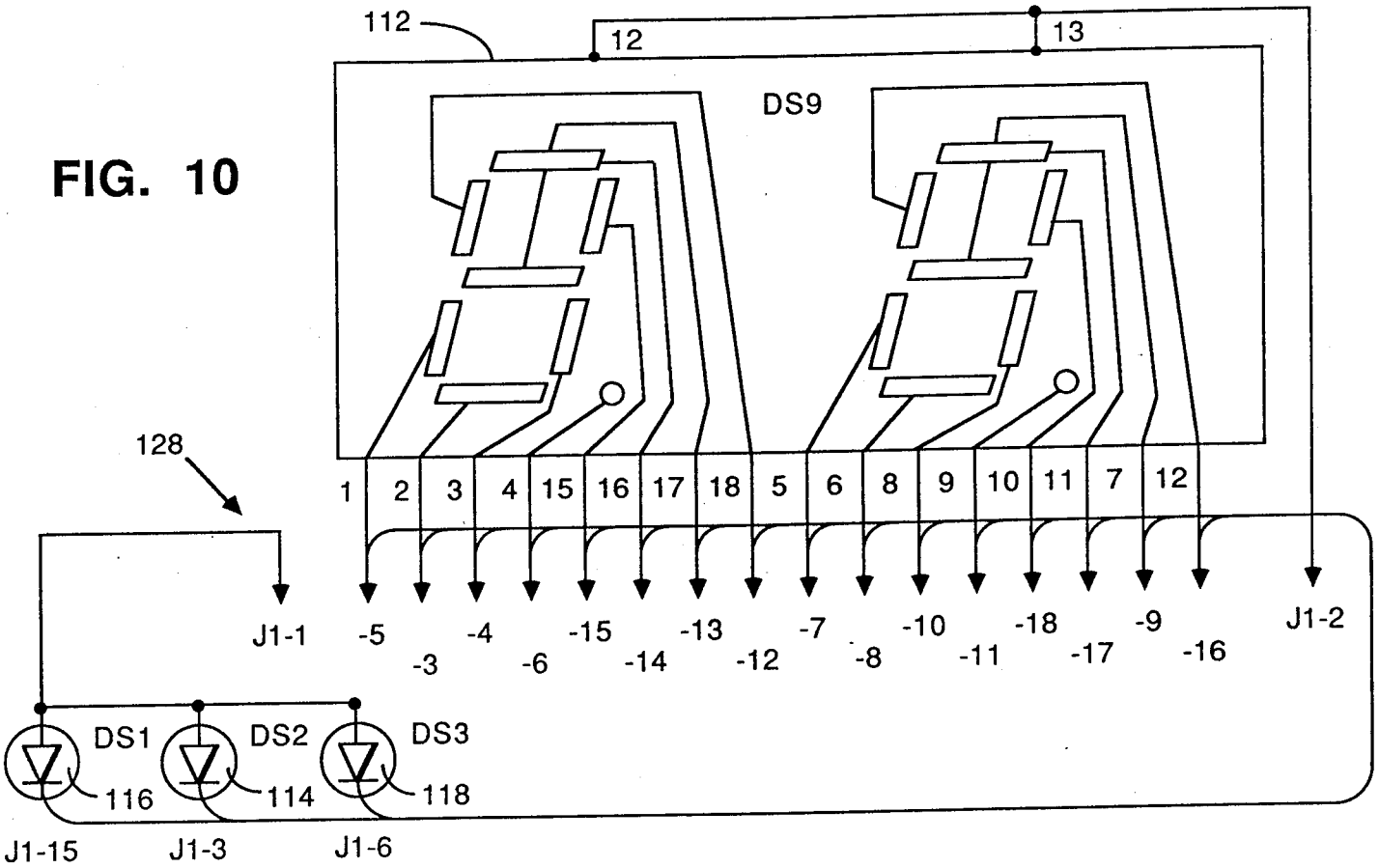
FIG. 10 is a detailed schematic of the display board of the electrical control system.

Outputs indicated generally at 154 together extend to display circuit board 128, which is shown in detail in FIG. 10. There, the numeric display 112, LEDs 114, 116 and 118 and the respective electrical connections can be seen.

Outputs from serial-to-parallel shift register 152 indicated at 156 are directed to motor controller 138 (see FIG. 8). Because carriage motor 58 is electronically commutated, output from register 152 can be used by motor controller 138 to advance carriage motor 58 in a desired direction, and more importantly, through a specific number of revolutions as a function of the number commutation pulses supplied to the motor. Consequently, motor direction, motor speed and carriage travel distance (directly related to carriage motor rotations) can be controlled.

The output indicated generally at 158 controls solenoid 92. As has been described, energization of solenoid 92 causes the food product carriage to engage the drive belt.

Figure 9B:
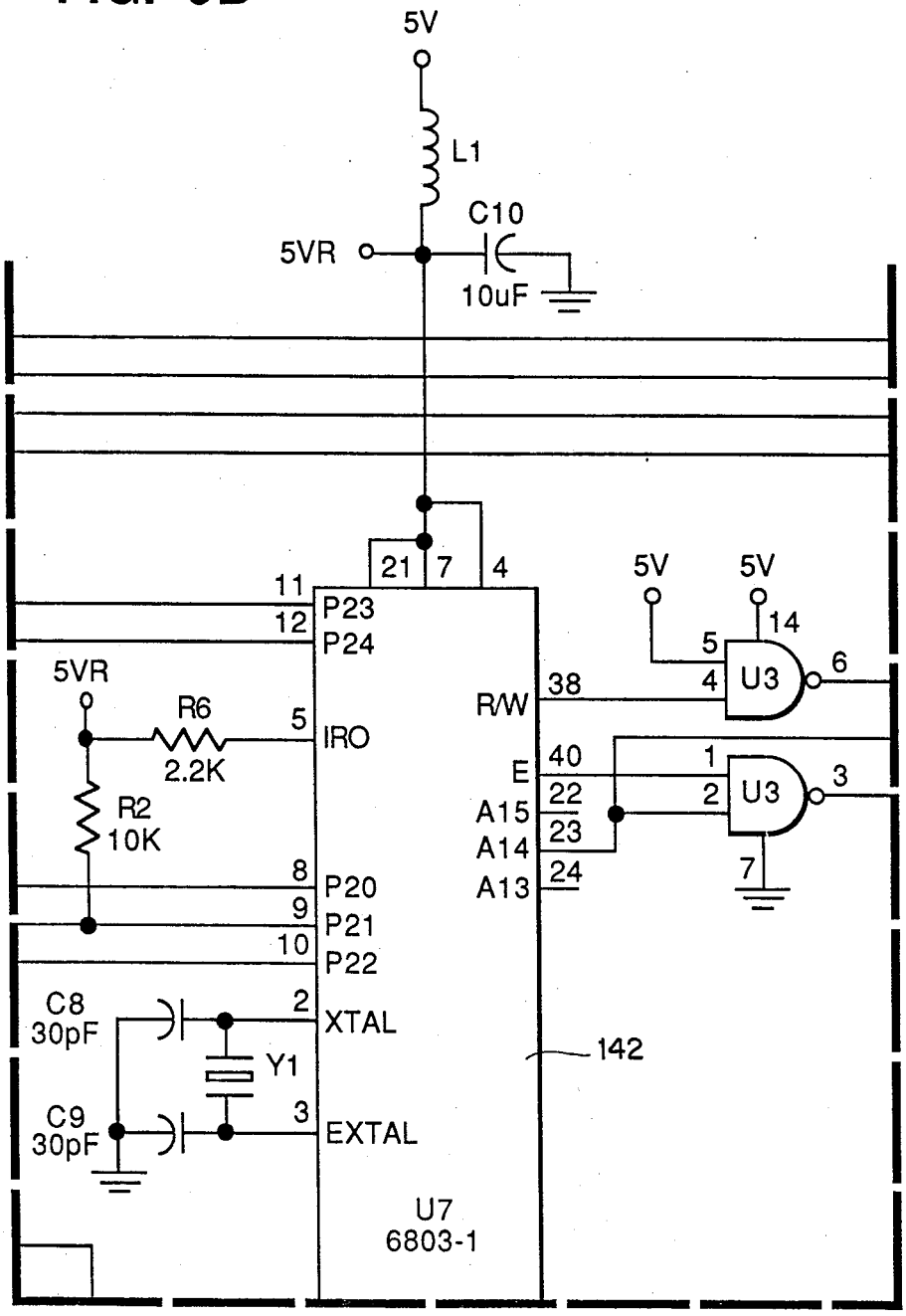
Figure 9C:
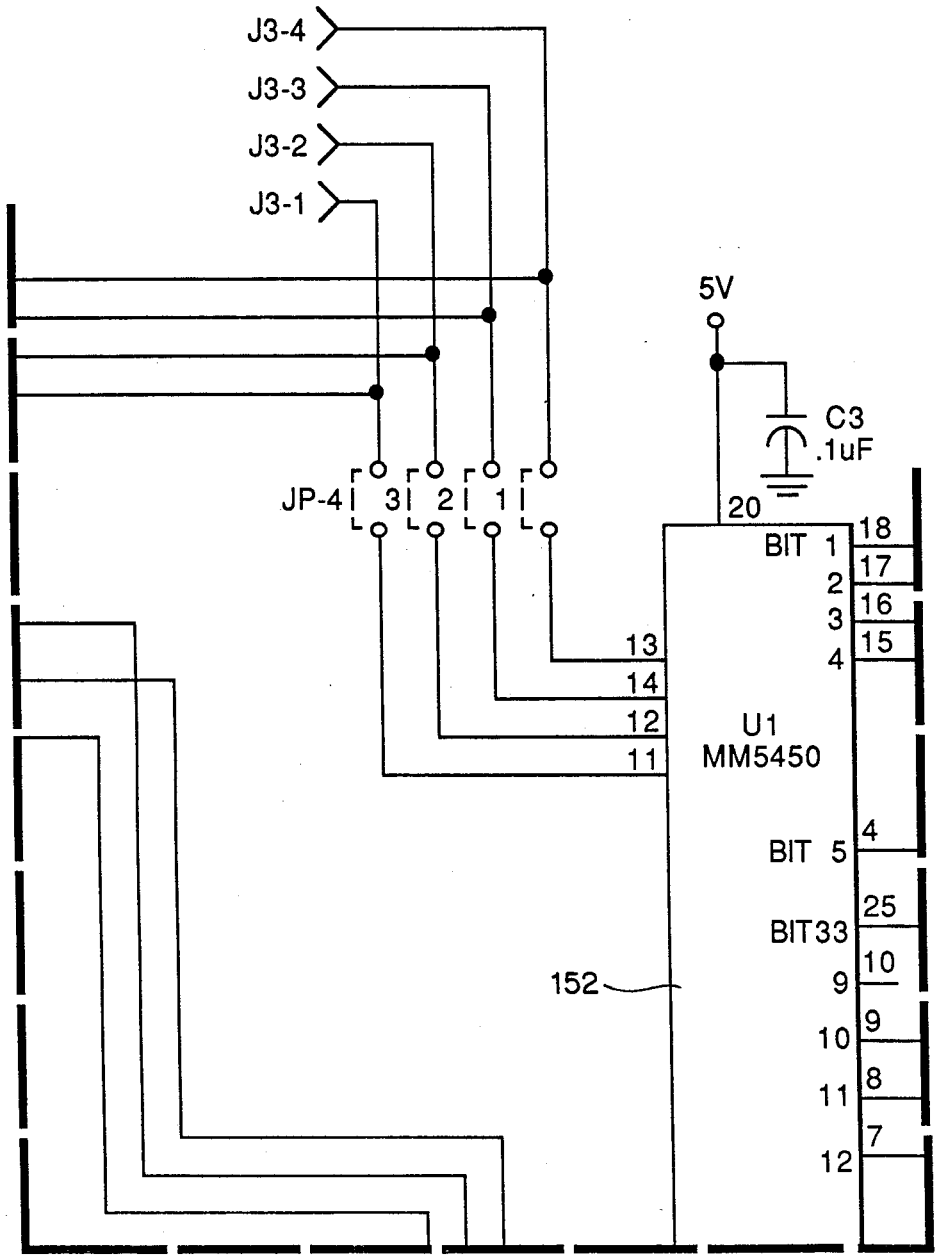
Figure 9D:
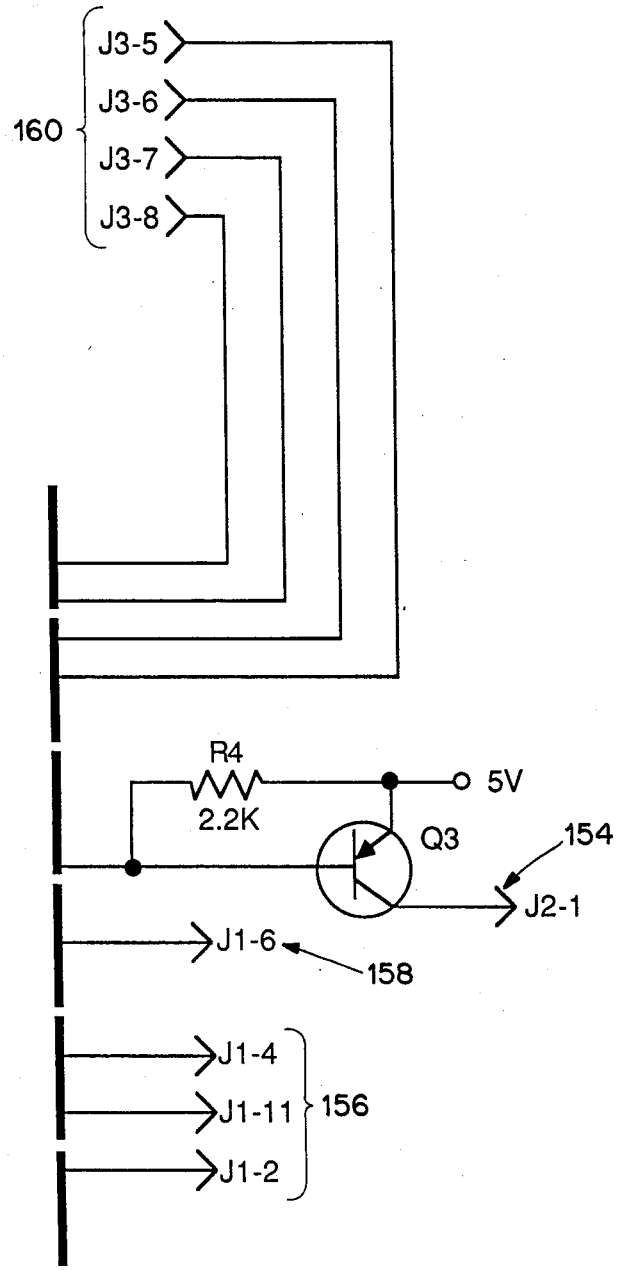
Figure 9E:
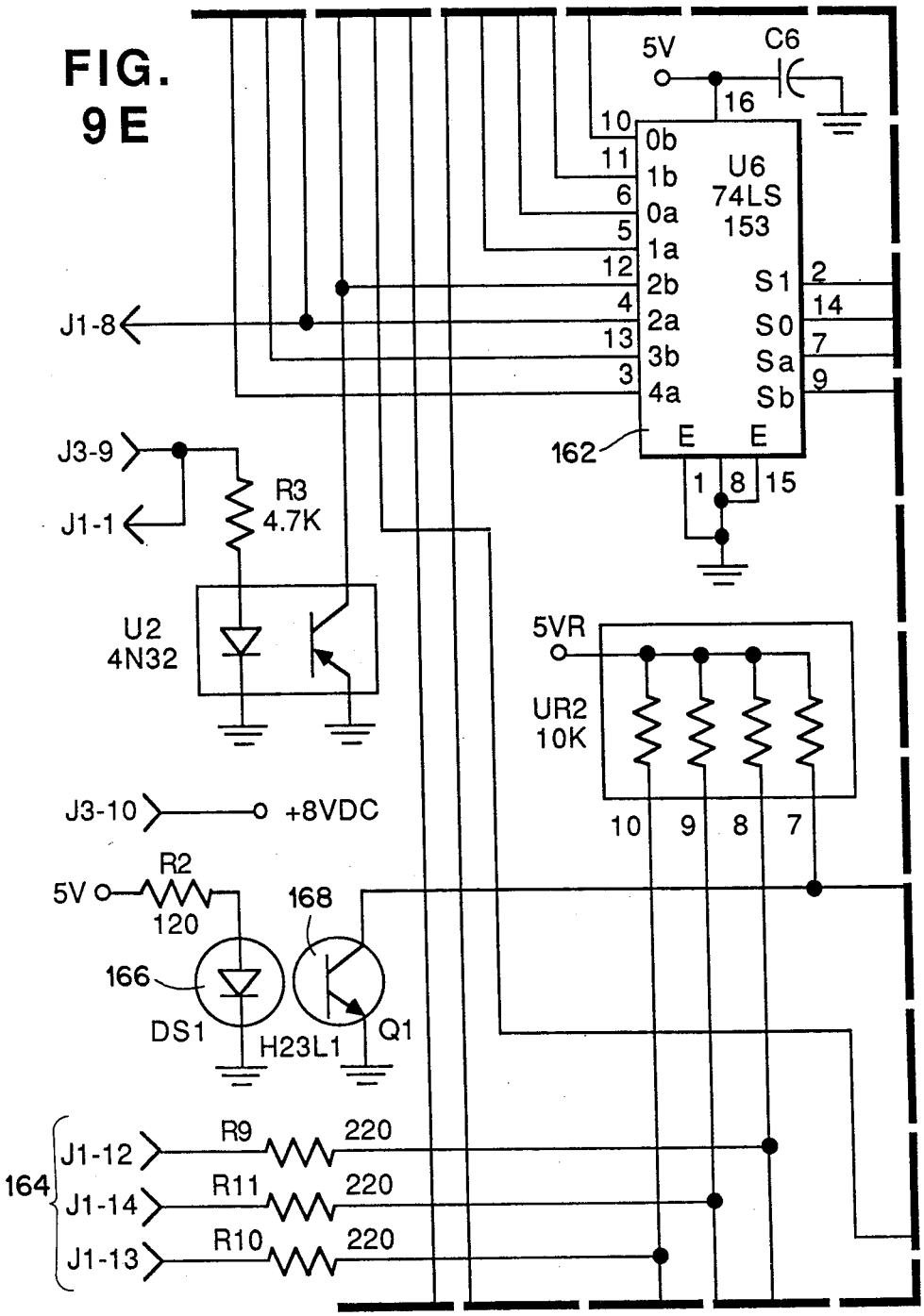
Figure 9F:
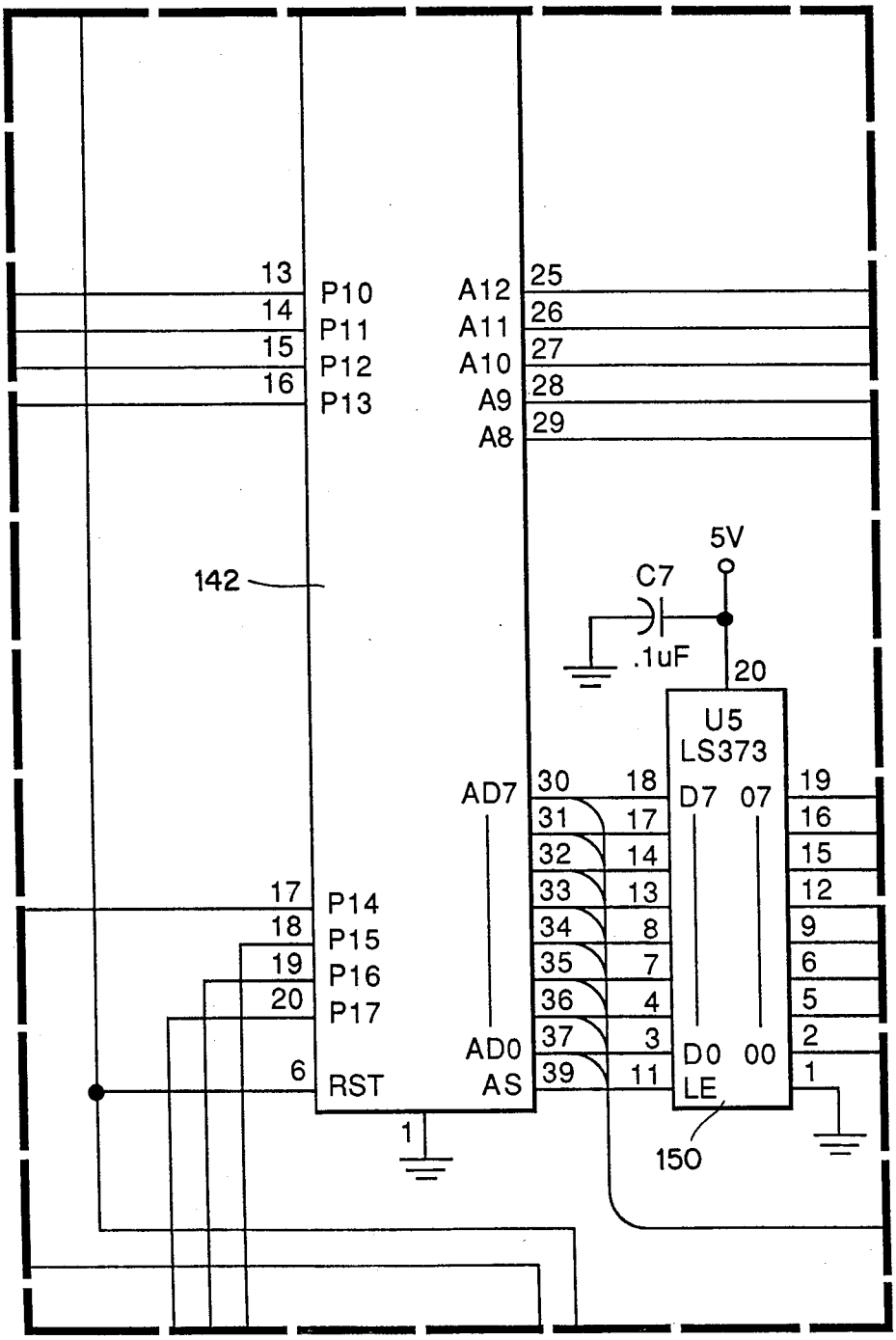
Figure 9G:
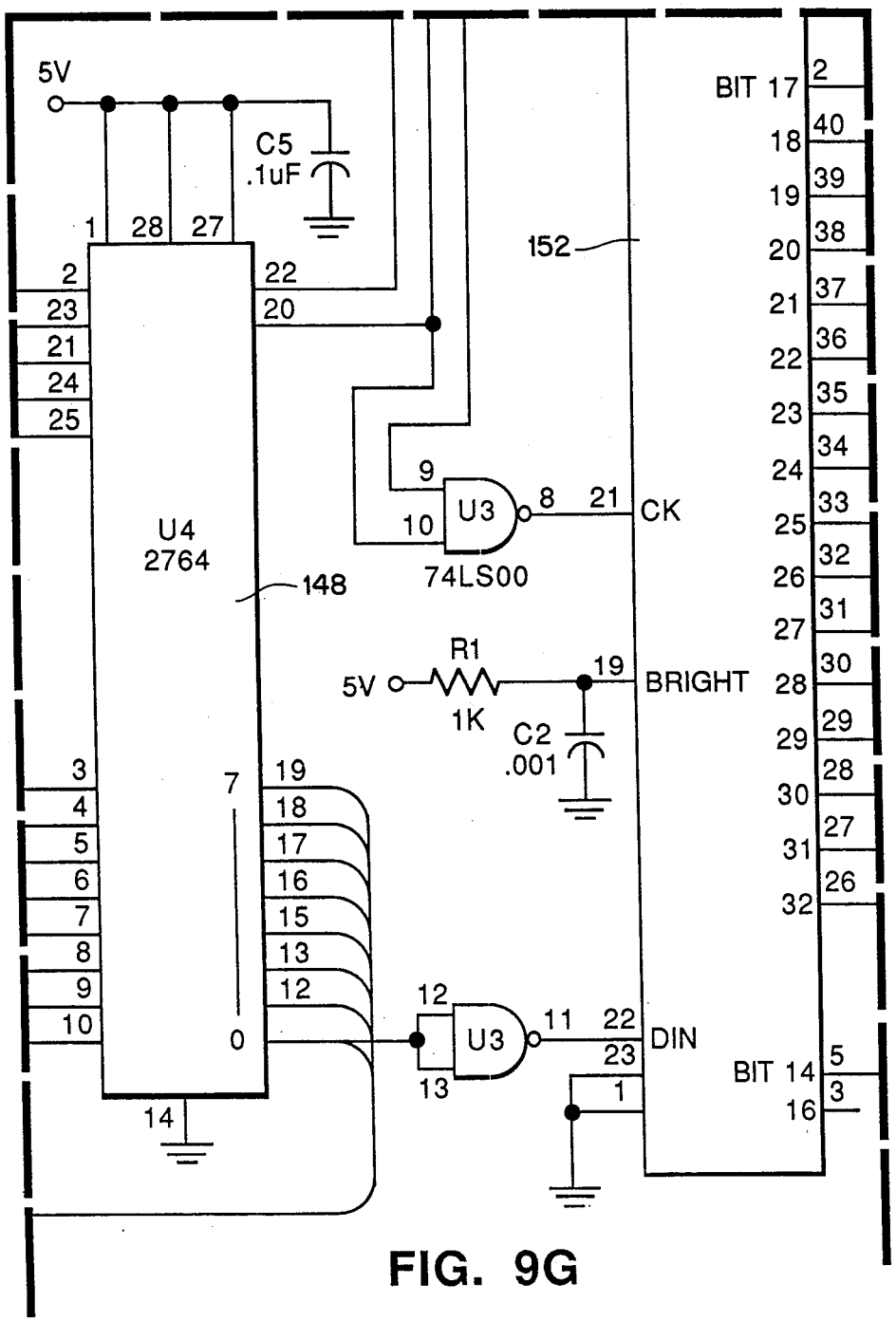
Figure 9H:
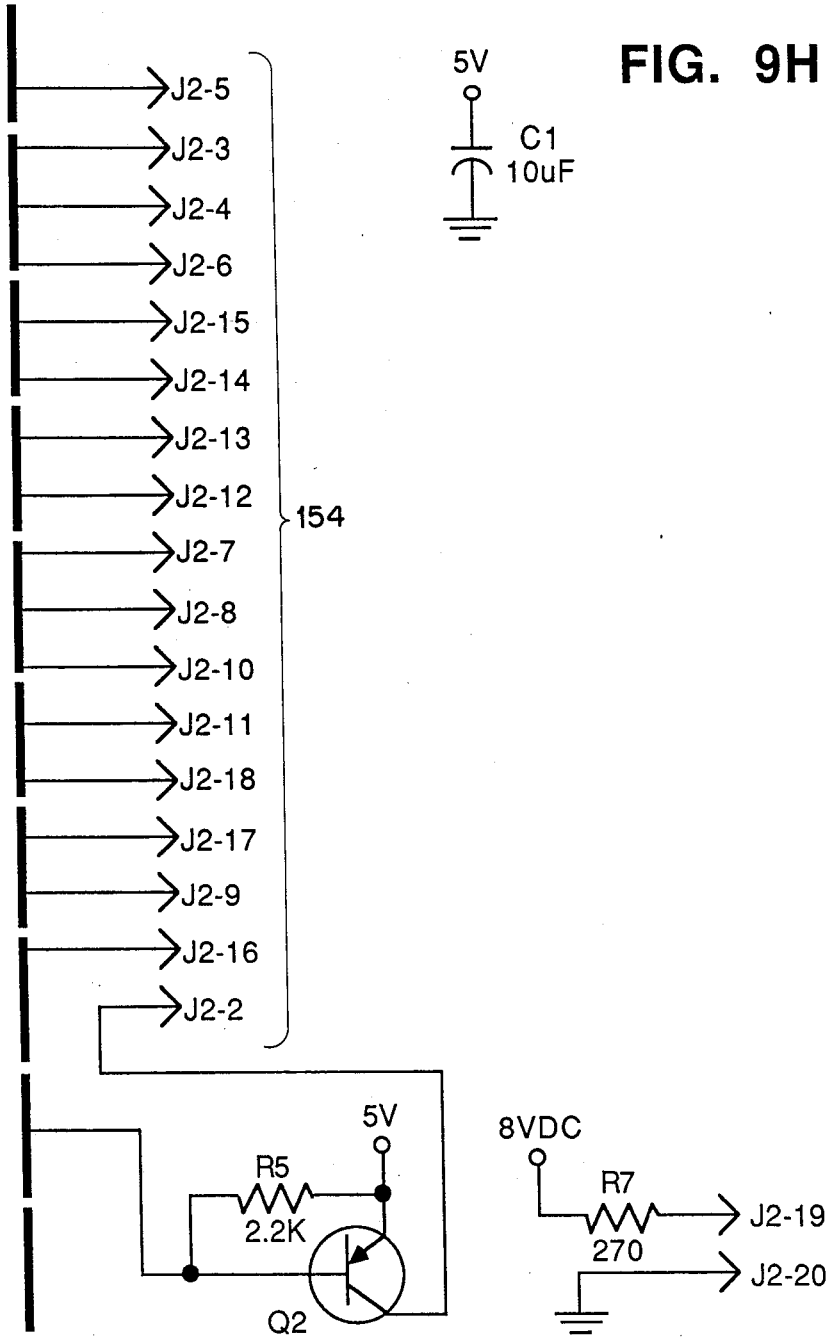
Figure 9I:
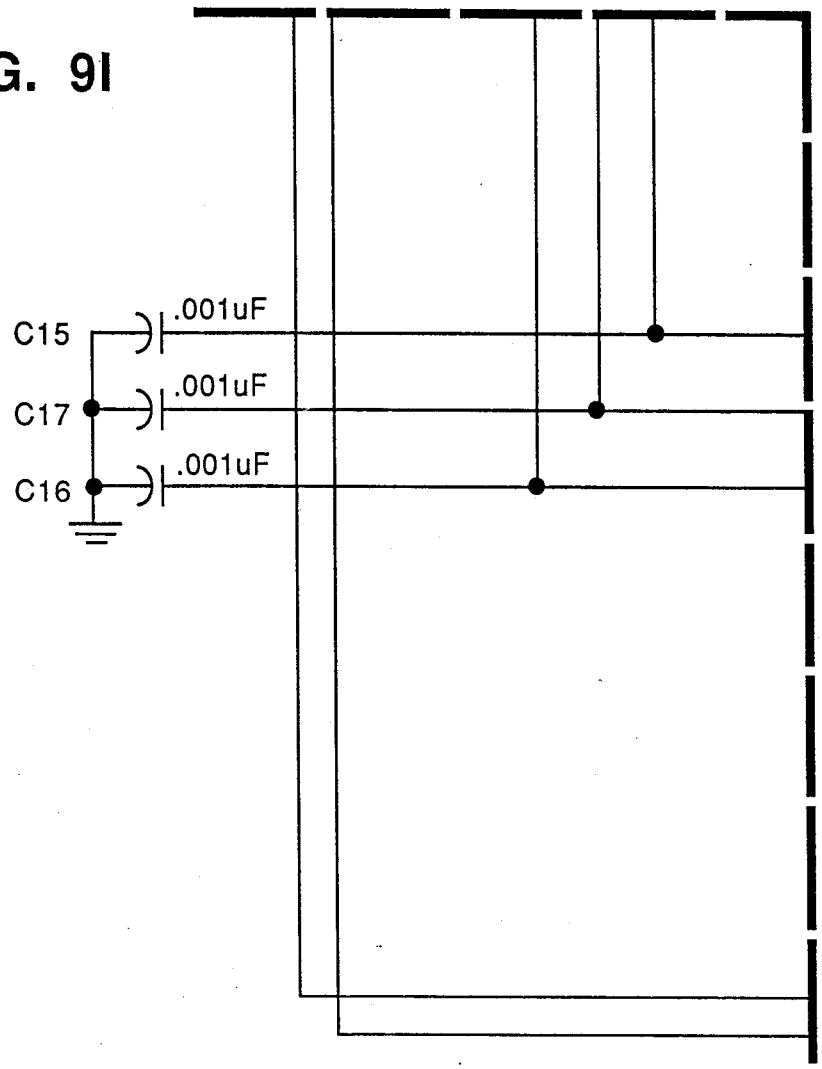
Figure 9J:
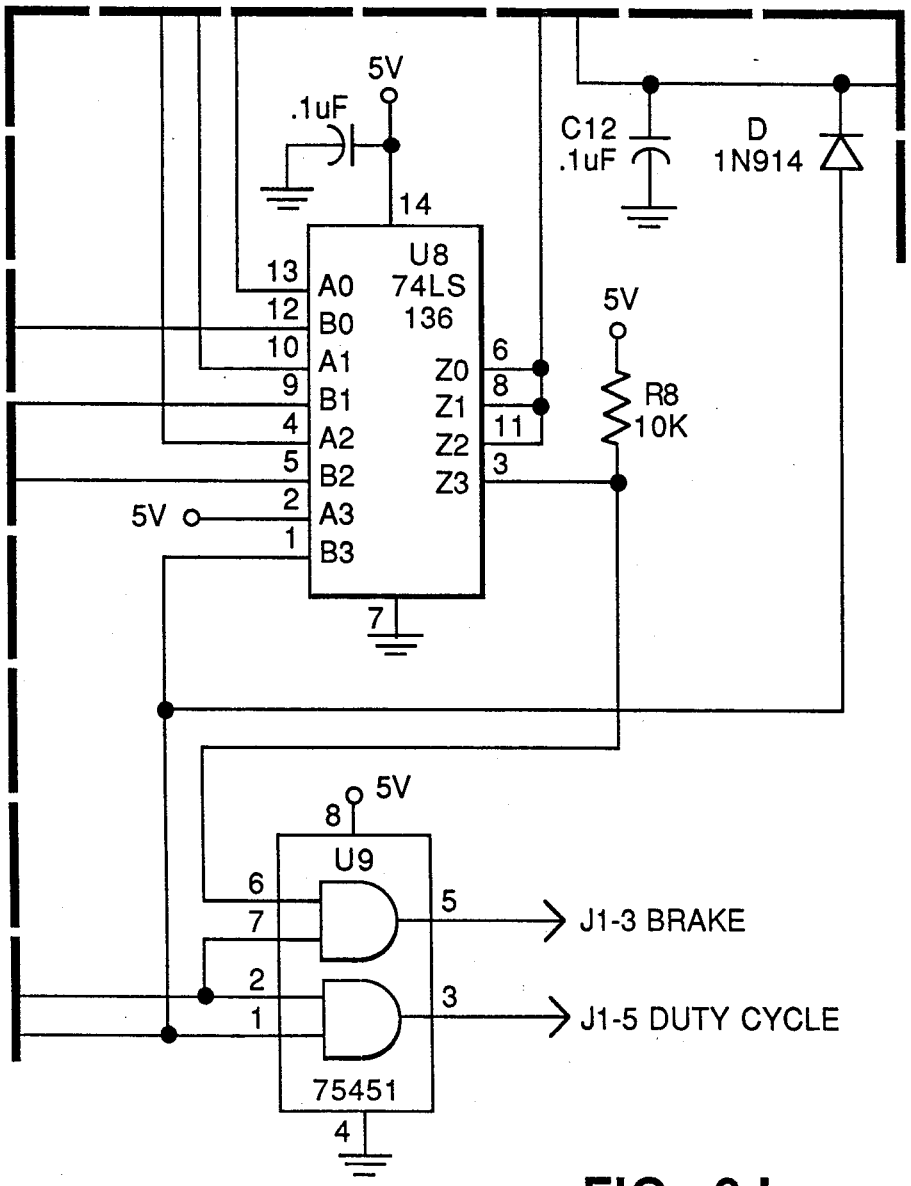
Figure 11:
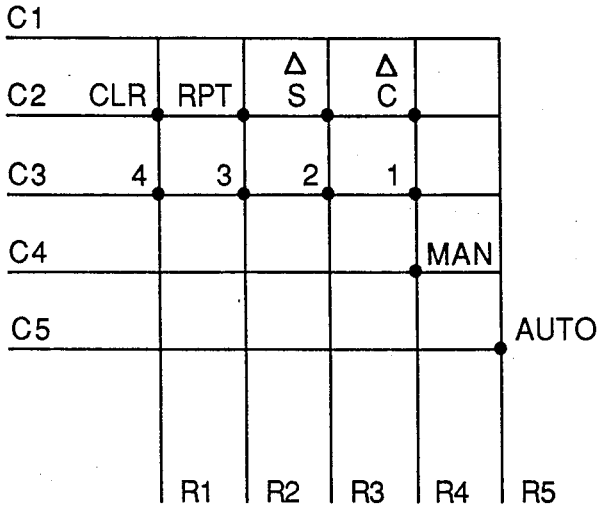
FIG. 11 is a detailed schematic of the keypad for the electrical control system.

A plurality of inputs, generally indicated at 160 (see both FIGS. 9B and 9C), are connected with keypad 124, which is shown in detail in FIG. 11. Keypad 124 is a conventional membrane type keypad, commercially available from a number of sources. Returning to FIG. 9, it will be additionally noted that inputs from keypad 124 are supplied to microprocessor 142 through an input multiplexer 162, which is preferably a 74LS153 chip commercially available from Motorola. Other inputs to microprocessor 142 include those indicated generally at 164, which are provided from motor controller 138 (FIG. 8). These inputs supply data concerning energization and movement of the carriage motor. Such data is in the form of a train of pulses generated by the Hall effect switches located within the motor.

One further input should be noted in detail. An LED 166 is connected to the power supply so that LED 166 is normally illuminated. A phototransistor 168 is mounted near LED 166, so that the presence of a beam from LED 166 can be supplied as an input to microprocessor 142. The LED/phototransistor pair is used as part of a home or reference position detector for the food product carriage. Referring back to FIG. 3, an elongated rod 170 extends from carriage support member 54. As support member 54 approaches the end of its travel path nearest end wall 48, rod 170 is passed through an opening 172 in end wall 48. While not shown in FIG. 3, LED 166 and phototransistor 168 are positioned on opposite sides of opening 172, so that as rod 170 passes through opening 172, it comes between LED 166 and phototransistor 168, thereby preventing the beam from LED 166 from falling upon phototransistor 168. In this manner, microprocessor 142 is supplied with an indication that carriage 18 is in a position adjacent end wall 48.

Referring back to FIG. 9, serial inputs and outputs are provided at 174 to microprocessor 142. Such input and output may be utilized for performing diagnostic routines, networking the slicer with other operating equipment, and the like.

Figure 12A:
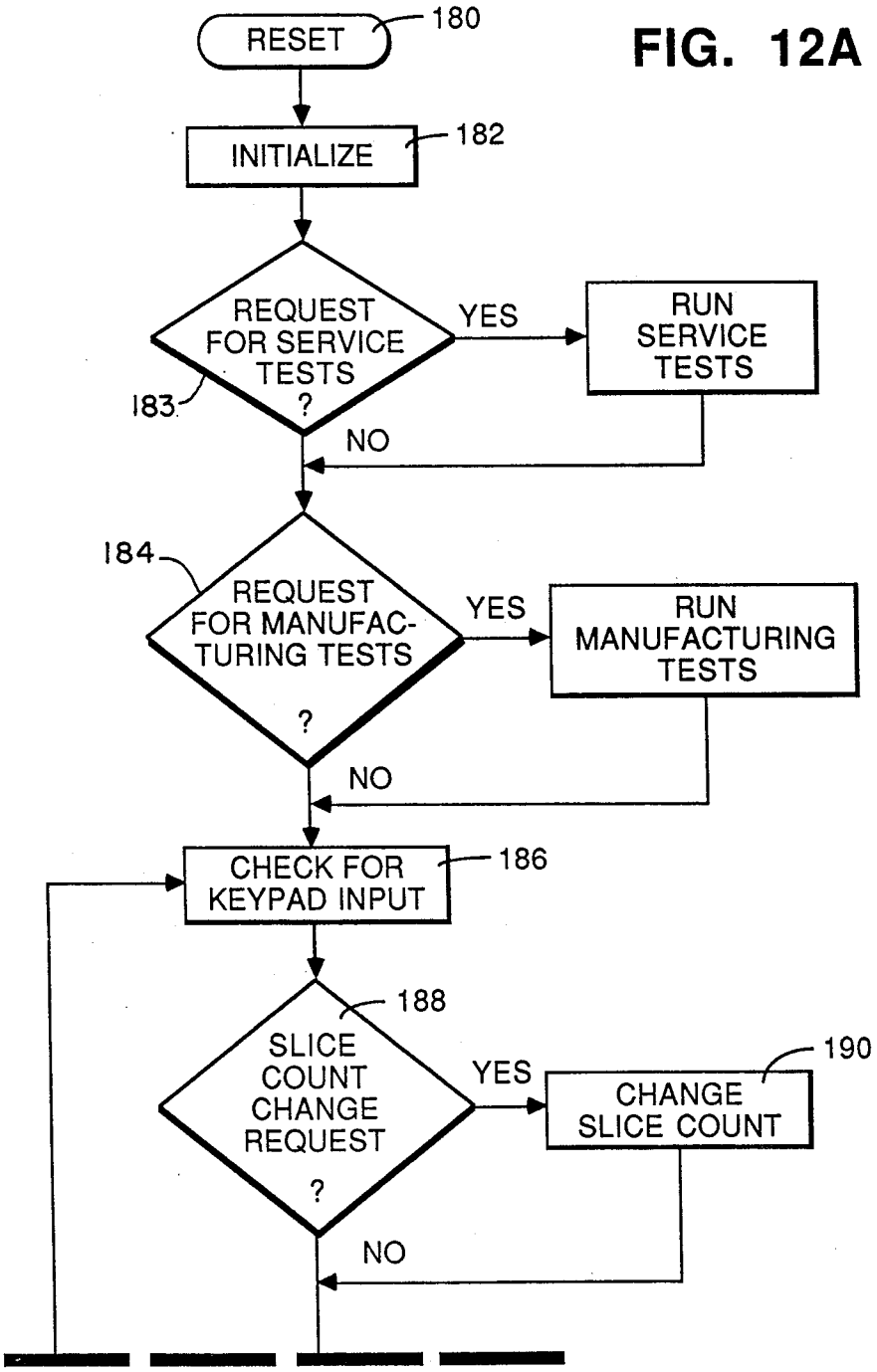
FIGS. 12A–12C together comprise FIG. 12, which is a flow chart diagram of the general microprocessor program for controlling the slicer.
Figure 12B:
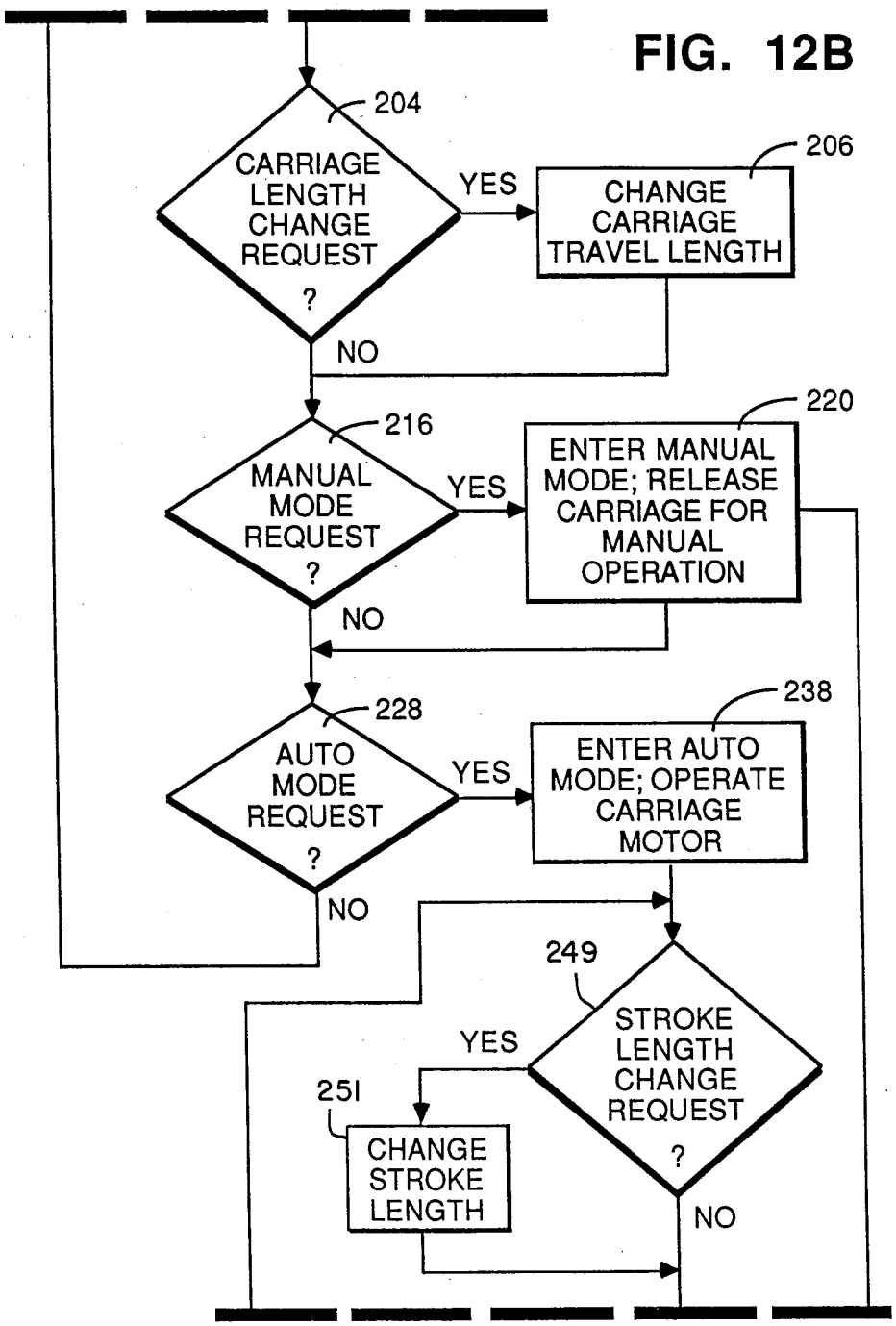
Figure 12C:
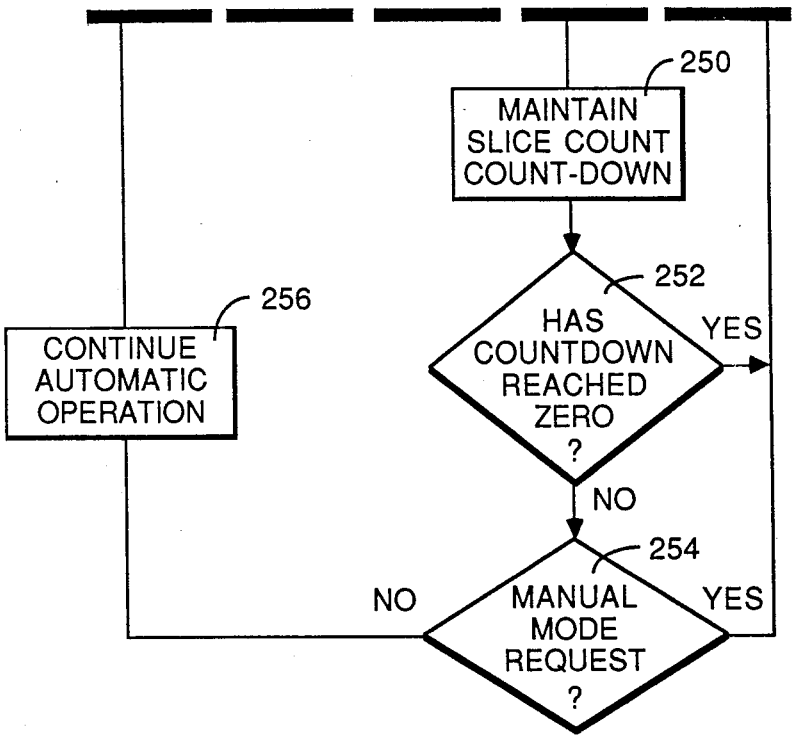

The operation of microprocessor 142 to control slicer operation, in accordance with a program contained within memory 148, will be best understood by reference to the flow chart diagram shown in FIG. 12. Upon power-up of the entire control system, microprocessor 142 is reset, showing a block 180, and then initialized as shown at block 182. Internal service and manufacturing tests may be called at blocks 183 and 184.

Entering the normal program loop, beginning at block 186, the program checks for various keypad input. First, in the event that a desired number of slices has been selected, at block 188, the slice count stored in memory (default value=0) is changed at block 190. It should be noted that it is not necessary to select a slice count, and in the absence of such a selection (value=0), the slicer when energized in the automatic operational mode will simply continue to operate until a request to enter the manual mode is received.

Figure 6:
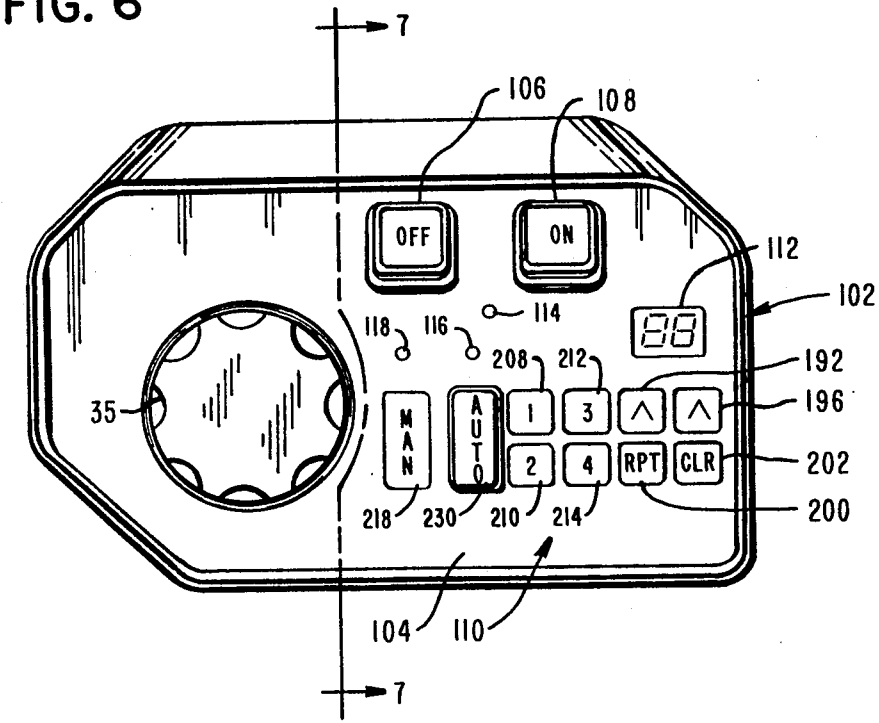
FIG. 6 is a front view of the housing cap supporting the operator actuated controls for the slicer.

Refering back to FIG. 6, it can be seen that the slice count is selected through the operation of switches 192, 196, 200 and 202. Actuation of any of these switches is interpreted by microprocessor 142 as a slice count change request. Switch 192 incrementally advances the tens unit of the slice count upwardly. Switch 196 incrementally advances the units counter of the slice count upwardly. Repeat switch 200 automatically selects a slice count identical to that most recently selected, while switch 202 clears the slice count and resets it to 0, representing an unspecified slice count. Prior to operation of the counter in an automatic mode, the selected slice count is displayed on display 112, and any changes in the selected slice count are likewise displayed.

Returning to FIG. 12, the program next inquires as to whether a change in carriage stroke length has been requested at block 204. If so, an appropriate change is stored in memory at 206. Referring back to FIG. 6, four preselected stroke lengths are available for automatic operation of the slicer. Each is designated by a numbered switch, with stroke length 1, selectable by switch 208 being the shortest in length, stroke length 2, selected by swith 210 being next longest, stroke length 3, selectable by switch 212, being next longest, and stroke length 4 being the longest, and encompassing essentially the entire length of the slicer. As will be described, stroke length selection is normally made prior to each automatic operation. Stroke length 4 is used as a default setting, automatially selected in the event no stroke length selection is made, and therefore need not be otherwise selectable. However, switch 214 is provided for causing the carriage to move within stroke length 4, but at a faster rate of speed. Such increase in speed is also stored within memory at block 206 of FIG. 12.

As shown in FIG. 12, the program next considers, at block 216, whether a manual mode request has been made. Such a request is entered by the operator by actuating the "manual" pushbutton switch 218 shown in FIG. 6. If such a request is made, as shown at block 220, the program causes the slicer to enter the manual mode, which returns the carriage to reference home position and releases the carriage from engagement with the drive belt for manual operation.

Figure 15:
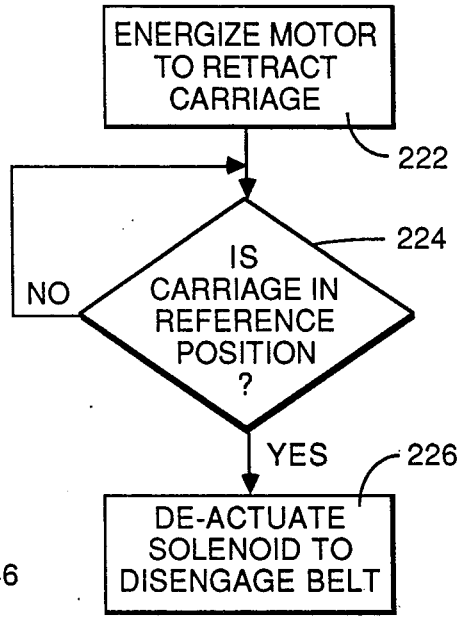
FIG. 15 is a flow chart diagram of the manual mode subroutine of the program.

The subroutine for entering the manual mode can be seen by reference to FIG. 15. At block 222, the motor is energized to retract the carriage until rod 170 (FIG. 3) enters opening 172 and breaks the beam between LED 166 (FIG. 9) and phototransistor 168. A continuous sampling is made at block 224 to determine whether such beam has been broken, in which case it will be known that the carriage has returned to its forward most or home position. Upon such event, in block 226, the solenoid is deactuated to cause the carriage to be disengaged from the drive belt. The carriage is thereupon released for manual operation.

Returning to FIG. 12, in the event no manual mode request is received, a determination is made at block 228 as to whether a request to start automatic operation has been received. Such a request is made by the operator actuating the "auto" pushbutton swith 230 as shown in FIG. 6. In the event no automatic operation request is received, the program returns to block 186, to again check for keypad input.

Figure 13:
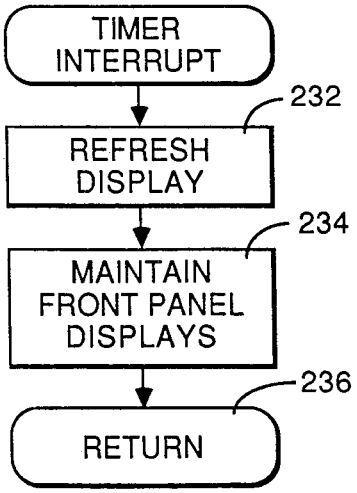
FIG. 13 is a flow chart diagram of the timer interrupt portion of the program.

Referring now to FIG. 13, a timer interrupt is performed at 2 millisecond intervals to refresh the display, shown at block 232. Next, the control panel displays are maintained at block 234, and the interrupt returns to the program at block 236.

Figure 14:
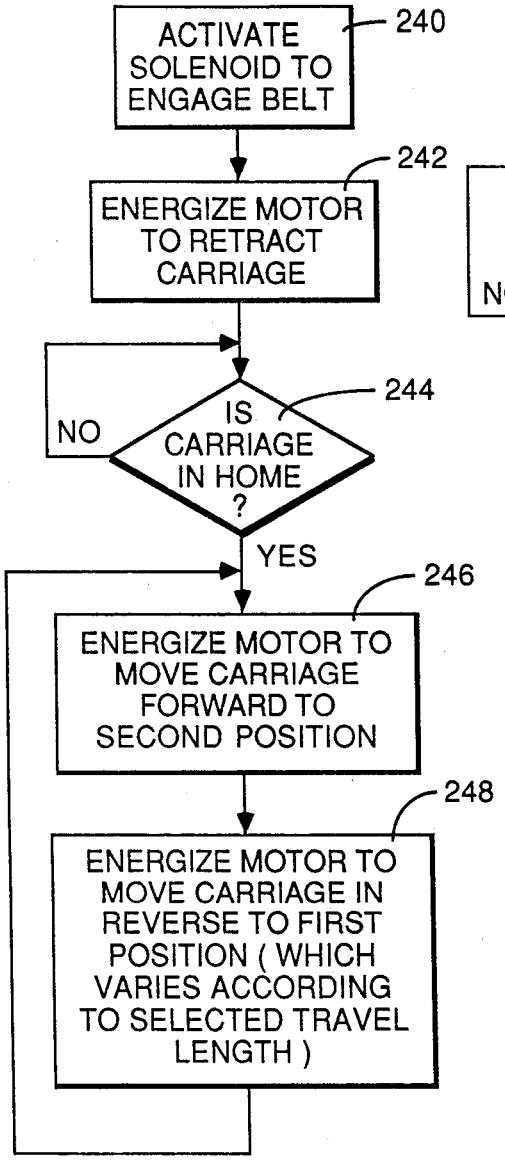
FIG. 14 is a flow chart diagram of the auto mode subroutine of the program.

In the event an auto mode request is received at block 228, the program enters the auto mode subroutine at block 238 to operate the carriage motor for automatic slicer operation. Referring now to FIG. 14, the solenoid is initially actuated at block 240 to cause the carriage support to engage the drive belt. Next, at block 242, the motor is energized to retract the carriage toward the control panel. A continuous sampling is made at block 244 to determine whether the carriage has arrived at the HOME position.

During manual operation of the slicer, the carriage may be moved to any point along its travel path independent of the toothed drive belt. It will be appreciated that upon commencing automatic operation, the slicer control system will not know the position of the carriage. Thus, by always returning to the HOME position prior to automatic operation, the positioning of the carriage can be initialized. In addition, by defining the HOME position at the fully retracted carriage position, i.e., closest to the operator, automatic operation of the slicer will not result in partial slices being formed at the beginning or end of slicer operation. Preferably, movement of the carriage to the HOME position is done at a slower speed than reciprocating driving of the carriage for producing slices. This provides for the initial automatic movement of the carriage at a relatively slow rate.

Once the carriage has been returned to home position, the motor is energized, shown at block 246, to cause the motor to advance the carriage through the starting position, or first position, and on to the second position. This movement is simultaneously monitored, due to the train of pulses received from the rotary shaft encoder mounted to the drive motor. The count of pulses received is compared with a stored value corresponding to the second position. When these values become equal, the carriage has reached the desired position and the motor is deenergized. The motor is now energized, block 248, in a reverse direction to move the carriage, during which time the pulse count is decremented for each pulse received. When the counted value equals the value corresponding to the first position, the carriage is again reversed. Reciprocating operation of the carriage continues for the duration of automatic operation.

Normally, the second position is located, for all stroke lengths selectable, at the farthest position along the available carriage path from the slicer operator. However, it will be recognized that it is possible to establish the second position for any particular stroke length at any position along the carriage path beyond the first position. This is because the second position is achieved by the carriage through energizing the motor for a sufficient number of pulse counts to advance the carriage from the first position to the second, and this number can be any value which does not advance the carriage beyond the mechanical limits of the carriage path.

If the longest stroke length has been selected, the HOME position and start position are the same. Thus, the number of pulses and the distance over which the carriage is moved from the reference HOME position to the start position is zero. In all other cases, reciprocating motion of the carriage will begin from a position remote from the HOME position.

In such other cases, the number of pulses necessary to move the carriage from the HOME position to the start position is other than zero. The control system, upon receiving the stroke length signal as described below, selects one of a predetermined number of stroke lengths for the slicer which correspond to a predetermined distance along the linear carriage path. Since the second position is fixed at a position along the linear path farthest from the reference position, the distance is determined by the location of the first or start position along the linear path. Of course, this position is identified simply by a predetermined number of pulses stored in the control system memory.

Returning to FIG. 12, as the slicer continues in automatic operation, the program advances to block 249 where a check is made to determine whether a stroke length change has been requested, and if so, the change is made at block 251. At block 250, each time a complete stroke has been performed (i.e., the carriage has been returned to home), the stored slice count is incremented downwardly. A determination is made at block 252 as to whether the countdown has reached zero. If so, the program moves to block 220, where automatic operation is stopped and the carriage is released to manual operation. If the slice countdown has not yet reached 0, or if no predetermined slice count was selected the program moves to block 254 where it is determined whether a stop (manual mode) request in the form of actuation of manual pushbutton switch 218 has occured. If not, the program continues in the automatic operational mode, at block 256. If such a request has been received, the program moves to block 220 for entry into the manual mode.

Referring once again to FIG. 6, slicer operation, as it appears to an operator of the slicer, is as follows. Power-up is achieved by actuation of push button "on" switch 108, and blade rotation begins. If manual operation is desired, switch 218 is depressed, whereupon the carriage is kept released from the drive belt for manual operation.

In the event automatic operation is desired, the auto switch 230 may simply be depressed, whereupon carriage movement begins. In such case automatic operation will be in accordance with default settings, and a long stroke length action at normal movement speed will be performed continuously until such time as manual switch 218 is depressed. Once auto switch 230 has been actuated, the carriage will move toward the operator until it has reached the home position closest to the operator. Then, automatic reciprocating motion will begin.

Prior to actuation of auto switch 230, the operator may actuate pushbutton switches 192, 194, 196 and 198 to preselect a number of slices. In such a case, after slicer operation commences, the preset number of slices will be formed. Afterwards, the slicer carriage will be returned to the home position and will be released for manual operation. While slicer operation occurs, the display 112 will indicate the number of slices yet to be formed.

Also prior to actuation of auto switch 230, the operator may depress one of stroke length switches 208, 210, 212 and 214. In such a case, automatic operation wil begin upon actuation of pushbutton switch 230, but with a stroke length determined by which pushbutton switch has been selected. If pushbutton switch 214 has been selected, the full stroke length will be used, and the carriage motor will operate at a faster speed. After actuation of auto swich 230, the operator may depress stroke length switches 208, 210, 212 and 214, in which case the stroke length will be changed.

After operations have been completed, the operator may depress "off" switch 106, whereupon blade rotation is stopped and power to the control system is terminated.

While the method herein described, and the form of apparatus for carrying this method into effect, constitute preferred embodiments of this invention, it is to be understood that the invention is not limited to this precise method and form of apparatus, and that changes may be made in either without departing from the scope of the invention, which is defined in the appended claims.

What is claimed is:

1. A method of automatically controlling a food product slicer having a rotating blade and a carriage for supporting the food product, said carriage being mounted for lateral reciprocating motion along a linear path with respect to said blade to bring the food product into and out of contact with the cutting periphery of said blade, the slicer further including a motor drivingly connected to said carriage for movement of said carriage along said path, comprising the steps of:

a. moving said carriage along said path by energization of said motor to a predefined reference position, in the event said carriage is initially in other than said reference position;

b. initializing a motor position count;

c. during all subsequent energization of said motor, generating a count wherein each increment of said count corresponds to an incremental distance of movement of said carriage along said path;

d. energizing said motor for a first number of counts sufficient to move said carriage to a first position along said path corresponding to a starting end of a slicing stroke; and e. energizing said motor for a second number of counts sufficient to move said carriage from said first position to a second position along said path corresponding to a completion end of said slicing stroke.

2. The method as defined in claim 1, comprising the further step of, prior to movement of said carriage to said reference position, selecting one of a predetermined number of stroke lengths for the slicer, each said stroke length corresponding to a predetermined distance along said linear path.

3. The method as defined in claim 2, wherein one of said predetermined number of stroke lengths includes a longest stroke length for which said reference and said first positions are coincident and said first number of counts is equal to zero.

4. The method as defined in claim 2, wherein said second position is fixed at a position along said linear path farthest from said reference position, and selection of said stroke length determines the location of said first position along said linear path.

5. The method as defined in claim 1, wherein said reference position is defined at a position along said path furthest from said blade.

6. The method as defined in claim 5, wherein any movement of said carriage to said reference position is made by moving said carriage in a first direction, and wherein any movement of said carriage to said first position is made by moving said carriage in a second, opposite direction.

7. The method as defined in claim 6, wherein movement of said carriage from said first position to said second position is also made by moving said carriage in said second direction.

8. The method as defined in claim 1, comprising the further step of:

f. energizing said motor for a third number of counts sufficient to move said carriage from said second position back to said first position along said path;

g. repeating steps e. and f. to produce a desired number of food product slices.

9. The method as defined in claim 8, comprising the further step of:

h. energizing said motor for a fourth number of counts sufficient to move said carriage along said path to said reference position.

10. The method as defined in claim 1, comprising the further step of:

f. energizing said motor for a third number of counts sufficient to move said carriage from said second position back to said first position along said path;

g. repeating steps e. and f. until termination of slicer operation is desired;

h. upon desiring termination of slicer operation, and after said carriage is last moved to said second position, energizing said motor for a fourth number of counts sufficient to move said carriage along said path to said reference position.

11. A food product slicer particularly adapted for automatic operation, comprising:

a frame;

a circular blade mounted for rotation to said frame and having a peripheral cutting edge;

means for rotationally driving said blade;

a carriage for supporting a food product;

means connected to said frame for mounting said carriage for lateral reciprocating motion along a linear path parallel with respect to the plane of said blade to bring the food product into and out of contact with the cutting edge of said blade;

a motor;

means for drivingly connecting said motor to said carriage for selective energization to produce movement of said carriage along said path;

count means for generating a count signal during energization of said motor, wherein each increment of said count corresponds to an incremental distance of movement of said carriage along said path;

sensor means mounted to said frame and said carriage for producing a reference signal upon positioning of said carriage along aid path in a reference position;

first operator-actuation of said switch means for producing an initiation signal upon actuation of said switch means; and control means (1) for receiving said initiation signal, said reference signal and said count signal and (2) for selectively controlling energization of said motor, upon receiving said initiation signal, in accordance with the following sequence:

a. energize said motor to move said carriage in a first direction along said path until said reference signal is received;

b. in response to receipt of said reference signal, deenergize said motor and initialize a cumulative count;

c. energize said motor to move said carriage along said path in a second, opposite direction and simultaneously receive said count signal and update said cumulative count therewith until said cumulative count equals a first value corresponding to a first position along said path corresponding to a first end of a slicing stroke; and d. energize said motor to move said carriage in said second direction along said path and simultaneously receive said count signal and update said cumulative count therewith until said cumulative count equals a second value corresponding to a second position along said path corresponding to a second, opposite end of said slicing stroke.

12. The slicer as defined in claim 11, wherein said means for drivingly connecting said motor to said carriage includes a pair of pulleys, one of said pulleys connected for rotation by said motor, an endless belt extending around said pulleys for driving by rotation of said pulleys, and clutch means for selectively engaging said carriage with said belt.

13. The slicer as defined in claim 12, wherein said clutch means for selectively engaging said carriage with said belt includes:

a series of teeth defined on one surface of said belt, and toothed gripping means formed on said carriage for engaging said teeth;

said gripping means including an arm connected to said carriage for gripping said belt between said arm and said carriage; and means for moving said arm with respect to said carriage for selectively releasing said belt.

14. The slicer as defined in claim 13, wherein said means for moving said arm includes an electrically-actuated solenoid.

15. The slicer as defined in claim 14, with said control means further for, upon receiving said initiation signal, actuating said solenoid to cause said carriage to engage said belt.

16. The slicer as defined in claim 11, wherein said motor includes a rotatable shaft and wherein said count means includes an incremental shaft encoder mounted to said motor, said encoder being connected to rotate with said motor shaft, whereby said encoder generates said count signal in response to energization of said motor.

17. The slicer as defined in claim 11, wherein said sensor means includes means for producing a beam of radiation mounted to said frame, means for detecting the presence of said beam mounted to said frame to receive said beam, and blocking means connected to said carriage for blocking said beam from said means for detecting, said means for producing, said means for detecting and said blocking means all being positioned so that said blocking means only blocks said beam when said carriage is in said reference position.

18. The slicer as defined in claim 17, wherein said means for producing said beam is an LED and said means for detecting said beam is a phototransistor.

19. The slicer as defined in claim 18, wherein said LED and said phototransistor are mounted to said frame adjacent said reference position, and wherein said blocking means includes a rod connected to said carriage for blocking said beam.

20. The slicer as defined in claim 11, wherein said reference position is defined at a position along said path nearest an operator of the slicer.

21. The slicer as defined in claim 11, further comprising second operator-actuated switch means for producing a stroke length signal, and with said control means further for, prior to movement of said carriage to said reference position, receiving said stroke length signal and in response thereto, selecting one of a predetermined number of stroke lengths for the slicer, each said stroke length corresponding to a predetermined distance along said linear path.

22. The slicer as defined in claim 21, wherein said second position is fixed at a position along said linear path farthest from said reference position, and with said control means further for selecting said stroke length by determining said first value of counts to correspond to the location of said first position along said linear path.

23. The slicer as defined in claim 22, wherein one of said predetermined number of stroke lengths includes a longest stroke length for which said reference and said first positions are coincident and said first value of counts is equal to zero.

24. The slicer as defined in claim 11, with said control means further for controlling energization of said motor, following the causing of step d., in accordance with the following sequence:

e. energize said motor for a third number of counts sufficient to move said carriage from said second position back to said first position along said path; and f. repeat steps d. and e. to produce a desired number of food product slices.

25. The slicer as defined in claim 24, further comprising third operator-actuated switch means for producing a slice count signal upon actuation, with said control means further for receiving said slice count signal and for selecting said desired number of food product slices, whereupon following production of said desired number of slices, said control means energizes said motor for a fourth number of counts sufficient to move said carriage to said reference position.

26. The slicer as defined in claim 25, wherein said means for drivingly connecting said motor to said carriage includes a selectively engagable clutch means, and with said control means further for, upon receiving said actuation signal, causing said clutch means to engage, and following production of said desired number of food product slices and subsequent movement of said carriage to said reference position, causing said clutch means to disengage.

27. The slicer as defined in claim 11, further comprising fourth operator-actuated switch means for producing a termination signal in response to actuation thereof, and with said control means further for, upon receiving said termination signal during operation of the slicer, and after said carriage is next moved to said second position, controlling energization of said motor for a fourth number of counts sufficient to move said carriage along said path to said reference position.

28. The slicer as defined in claim 27, wherein said motor is drivingly connected to said carriage by selectively engagable clutch means, and with said control means further for, upon receiving said actuation signal, causing said clutch means to engage, and following receipt of said termination signal and subsequent movement of said carriage to said reference position, causing said clutch means to disengage.

29. A method of automatically controlling a food product slicer having a rotating blade and a carriage for supporting the food product, said carriage being mounted for lateral reciprocating motion along a linear path with respect to said blade to bring the food product into and out of contact with the cutting periphery of said blade by motion in, respectively, second and first directions, the slicer further including a motor and clutch means for drivingly connecting said motor to said carriage for movement of said carriage along said path, comprising the sequential steps of:

a. causing said clutch means to drivingly engage said motor and said carriage;

b. energizing said motor to move said carriage in said first direction away from said blade toward the operator along said path to a reference position defined along said path by maximum movement in said first direction furthest from said blade "regardless of carriage's initial position along said path"; and c. energizing said motor to move said carriage reciprocatingly along said path.

30. The method as defined in claim 29, further comprising the steps of:

d. following reciprocating movement of said carriage along said path, energizing said motor to move said carriage to said reference position; and e. upon movement of said carriage to said reference position, causing said clutch means to release said motor from said carriage, whereby said carriage is released for manual operation.

31. The method as defined in claim 29, wherein said motor is energized to move said carriage to said reference position at a first speed, and is energized to subsequently reciprocatingly move said carriage at a second, faster speed.

32. A food product slicer particularly adapted for both manual and automatic operation, comprising:

a frame;

a circular blade mounted for rotation to said frame and having a peripheral cutting edge;

means for rotationally driving said blade;

a carriage for supporting a food product;

means connected to said frame for mounting said carriage for lateral reciprocating motion along a linear path parallel with respect to the plane of said blade to bring the food product into and out of contact with the cutting edge of said blade by motion in, respectively, second and first directions;

a carriage motor;

clutch means for selectively engaging said carriage motor to said carriage for driving movement of said carriage by said motor along said path;

sensor means mounted to said frame and said carriage for producing a reference signal upon positioning of said carriage along said path in a reference position, said reference position being defined along said path by maximum movement in said first direction, nearest an operator of the slicer;

first operator-actuated switch means for producing an initiation signal upon actuation of said switch means; and control means (1) for receiving said initiation signal, said reference signal and said count signal, (2) for selectively causing said clutch means to engage and disengage said motor and said carriage and (3) for controlling energization of said motor, upon receiving said initiation signal, in accordance with the following sequence:

a. cause said clutch means to drivingly engage said motor and said carriage;

b. energize said motor to move said carriage in a first direction toward the operator along said path until said reference signal is received; and c. in response to receipt of said reference signal, energize said motor to move said carriage reciprocatingly along said path.

33. The slicer as defined in claim 32, with said control means further for controlling energization of said motor and causing said clutch means to engage and disengage said motor and said carriage, upon completion of reciprocating movement of said carriage along said path, in accordance with the following sequence:

a. energize said motor to move said carriage in said first direction toward the operator along said path until said reference signal is received; and b. in response to receipt of said reference signal, cause said clutch means to disengage said motor and said carriage, whereby said carriage is released for manual operation.

34. The slicer as defined in claim 32, further comprising carriage drive means including a pair of pulleys, one of said pulleys connected for rotation by said motor, and an endless belt extending around said pulleys for driving by rotation of said pulleys, said clutch means being for engaging said carriage with said belt.

35. The slicer as defined in claim 34, wherein said clutch means includes a series of teeth defined on one surface of said belt, and toothed gripping means formed on said carriage for engaging said teeth.

36. The slicer as defined in claim 35, wherein said gripping means includes an arm connected to said carriage for gripping said belt between said arm and said carriage, and further includes means for moving said arm with respect to said carriage for selectively releasing said belt.

37. The slicer as defined in claim 36, wherein said means for moving said arm includes an electrically-actuated solenoid.

38. The slicer as defined in claim 37, wherein said control means is constructed for, upon receiving said initiation signal, actuating said solenoid to cause said carriage to engage said belt.

39. The slicer as defined in claim 32, wherein said sensor means includes means for producing a beam of radiation mounted to said frame, means for detecting the presence of said beam mounted to said frame to receive said beam, and blocking means connected to said carriage for blocking said beam from said means for detecting, said means for producing, said means for detecting and said blocking means all being positioned so that said blocking means only blocks said beam when said carriage is in said reference position.

40. The slicer as defined in claim 39, wherein said means for producing said beam is an LED and said means for detecting said beam is a phototransistor.

41. The slicer as defined in claim 40, wherein said LED and said phototransistor are mounted to said frame adjacent said reference position, and wherein said blocking means includes a rod connected to said carriage for blocking said beam.

* * * * *

UNITED STATES PATENT AND TRADEMARK OFFICE

CERTIFICATE OF CORRECTION

PATENT NO. : 4,813,316

DATED : March 21, 1989

INVENTOR(S) : Kevin K. Johnson, Gerald M. Bruckner, Brian E. Bader

It is certified that error appears in the above-identified patent and that said Letters Patent is hereby corrected as shown below:

In the Abstract

Line 13, "carraige" should be --carriage--.

Column 6, Claim 11, line 22, "aid" should be -- said --.

Column 6, Claim 11, line 24, "operator-actuation of said switch" should be --operator-actuated switch--.

Signed and Sealed this

Twenty-sixth Day of September, 1989

*Attest:*

*Attesting Officer*

DONALD J. QUIGG

*Commissioner of Patents and Trademarks*